US005787714A

United States Patent [19]

Ohkura et al.

[11] Patent Number: 5,787,714

[45] Date of Patent: Aug. 4, 1998

[54] COOLING METHOD AND ENERGIZING METHOD OF SUPERCONDUCTOR

[75] Inventors: Kengo Ohkura; Kenichi Sato, both of Osaka, Japan

[73] Assignee: Sumitomo Electric Industries, Ltd., Osaka, Japan

[21] Appl. No.: 897,605

[22] Filed: Jul. 21, 1997

[30] Foreign Application Priority Data

| | | | |
|---|---|---|---|
| Jul. 19, 1996 | [JP] | Japan | 8-190368 |
| Mar. 31, 1997 | [JP] | Japan | 9-080189 |
| Mar. 31, 1997 | [JP] | Japan | 9-080190 |

[51] Int. Cl.[6] ..... F25B 19/00

[52] U.S. Cl. ..... 62/51.1; 62/437

[58] Field of Search ..... 62/51.1, 54.2, 62/434, 437

[56] References Cited

U.S. PATENT DOCUMENTS

| | | | |
|---|---|---|---|
| 2,938,359 | 5/1960 | Cobb, Jr. et al. | 62/54.3 |
| 5,339,650 | 8/1994 | Hakamada et al. | 62/51.1 |
| 5,347,819 | 9/1994 | Sasi et al. | 62/434 |

OTHER PUBLICATIONS

Patent Abstracts of Japan, Pub. No. 60028211, Feb. 1985.
Patent Abstracts of Japan, Pub. No. 60025202, Feb. 1985.
Patent Abstracts of Japan, Pub. No. 04258103, Sep. 1992.
Patent Abstracts of Japan, Pub. No. 01028905, Jan. 1989.

*Primary Examiner*—Ronald C. Capossela
*Attorney, Agent, or Firm*—Foley & Lardner

[57] ABSTRACT

A method is provided for cooling a high temperature superconductor such as an oxide superconductor to a lower temperature at a lower cost with a more simple system. A superconducting coil is attached to a cooling stage of a refrigerator. By immersing the superconducting coil on the cooling stage in liquid nitrogen, the superconducting coil is cooled rapidly. Then, the superconducting coil is further cooled by the refrigerator. By the cooling operation of the refrigerator, the liquid nitrogen is solidified. Thus, the superconducting coil is surrounded with solidifed nitrogen. The superconducting coil covered with the solidified nitrogen is further cooled by the refrigerator. In the superconducting coil cooled to a lower temperature and covered with solid nitrogen, quenching is suppressed to allow a higher current to be conducted.

15 Claims, 21 Drawing Sheets

COOLING METHOD AND ENERGIZING METHOD OF SUPERCONDUCTOR

BACKGROUND OF THE INVENTION

1. Field of the Invention

The present invention relates to a cooling method and an energizing method of a superconductor. More particularly, the present invention relates to a method of cooling an apparatus, equipment, device, and the like using a material that can exhibit a superconducting state at a higher temperature such as an oxide superconductor easily and rapidly to a temperature where a high critical density is obtained, and an energizing method using the cooling method.

2. Description of the Background Art

In order to generate a superconducting state and maintain that level stably in a superconductor, the superconductor must be cooled to a temperature below the critical temperature. The cooling method includes the method of cooling a superconductor with a coolant such as liquid helium, and the method of cooling the superconductor directly with a cryogenic refrigerator. In general, the cooling method of a superconducting magnet using a coolant can be classified into a pool cooling method where the object to be cooled such as a superconducting coil is directly provided in liquid helium, and a force feed circulation cooling method where the object to be cooled provided in a vacuum vessel is cooled via a heat exchanger which employs circulating helium. In the method employing a refrigerator, various different types of refrigerators are used depending upon the scale of the required refrigerating capacity. When a refrigeration capacity of kW level is required, a refrigerator having an expansion turbine is employed. When a material that exhibits a superconducting state at a higher refrigeration temperature such as an oxide superconductor is to be cooled, a two-stage expansion type refrigerator by Solvay, G-M cycle, and the like can be used.

Japanese Patent Laying-Open No. 60-28211 discloses a cooling method, in which a shield cooled by a refrigerator is provided between an outer vessel and an inner vessel which holds liquid helium in an apparatus for cooling a superconducting magnet with liquid helium, and a power lead connected to the superconducting magnet is also cooled by a refrigerator. Japanese Patent Laying-Open No. 60-25202 discloses a superconducting electromagnet apparatus for cooling a superconducting coil directly by a refrigerator. In this apparatus, the superconducting coil accommodated in a vacuum vessel is surrounded by a radiation shield. The radiation shield and the superconducting coil are directly cooled by the thermal conduction of the refrigerator. Japanese Patent Laying-Open No. 4-258103 also discloses an apparatus for cooling a superconducting coil directly by a refrigerator. As shown in FIG. 28, this apparatus has a superconducting coil 91 fixed to a cooling stage 94 of a cooling storage type refrigerator 93. A thermal shield 83 surrounding superconducting coil 91 is fixed to another cooling stage 95 of refrigerator 93. Superconducting coil 91 and thermal shield 83 are accommodated in a vacuum vessel 92. During the cooling operation of superconducting coil 91 via cooling stage 94, thermal shield 83 is cooled by the other cooling stage 95 to have its radiant heat from ambient temperature suppressed. A sample 96 to be subjected to magnetic field is inserted in superconducting coil 91 to which power is supplied via a current lead 99.

Japanese Patent Laying-Open No. 64-28905 discloses a method of cooling a superconducting coil by covering the same with a solid refrigerant. FIG. 29 shows a superconducting magnet using this cooling method. A superconducting coil 103 of a high temperature superconductor such as an yttrium based oxide superconductor is accommodated in a coil vessel 102 formed of a metal such as stainless steel. A solid refrigerant 105 which is solidified liquid nitrogen is provided in coil vessel 102. A soaking plate 108 such as of copper, aluminum, and the like is attached at the outer face of coil vessel 102. A small refrigerator 106 is attached to a portion of soaking plate 108. The process of covering superconducting coil 103 with solid refrigerant 105 is set forth in the following.

Liquid nitrogen is introduced into coil vessel 102. The liquid nitrogen is cooled by a small refrigerator 106. Coil vessel 102 is cooled by small refrigerator 106 via soaking plate 108. By evacuating coil vessel 102 using a vacuum pumping system 107 under the state where the liquid nitrogen is cooled by small refrigerator 106, the liquid nitrogen is converted into solid nitrogen. Then, by effecting cooling with a refrigerator 106 having a refrigeration capacity greater than the total amount of invasive heat, the solid phase of nitrogen around superconducting coil 102 is maintained.

When a superconductor having a high critical temperature such as an oxide superconductor is cooled according to the conventional method, problems set forth in the following were encountered. In the case of cooling an oxide superconductor using liquid helium, a high critical current density can be obtained by virtue of its low cooling temperature. However, liquid helium is an expensive refrigerant. Also, the system using liquid helium requires a complicated heat insulating structure. Liquid nitrogen that is more economic can be used as an alternative to liquid helium. However, the cooling temperature becomes higher when an oxide superconductor is cooled using liquid nitrogen. This means that the obtained critical current density is extremely reduced. In general, as the temperature is lower, the pinning potential of the magnetic flux that determines the critical current density becomes deeper to suppress the action of the magnetic flux inside the super conductor that becomes the cause of heat generation. As a result, a high critical current density is obtained. The pinning point depends upon the working history of the wire that forms the superconducting coil. Lattice defect, small impurities and the like can generate a pinning point. Therefore, a lower cooling temperature is desirable from the standpoint of obtaining a higher critical current density.

According to a cooling method using a refrigerator, two stages of a cooling temperature, 4.2K and 20K, for example, can be achieved to obtain a relatively high critical current density. However, the cooling method using a refrigerator is disadvantageous in that the initial cooling before a superconducting state is achieved is time consuming. Structures such as superconducting coils have an electric insulating material and the like, so that the thermal conductivity is not so high. The cooling operation of such a structure having an insulating material by a refrigerator requires a longer time period. The diffusion of heat generated within the coil via a cooling stage is restricted by the electric insulating material and the like used for the coil. Therefore, to avoid occurrence of quenching, a relatively low current is conducted to the superconductor in the conventional method of directly cooling a superconductor using a refrigerator.

According to the technique disclosed in Japanese Patent Laying-Open No. 64-28905, the superconducting coil is fixed by a solidified refrigerant. The solid refrigerant can function as a support member with respect to the electromagnetic force of the coil and other external forces.

Furthermore, the generated heat when quenching occurs in the superconducting coil can be absorbed by the melting action of the solid refrigerant. However, the technique disclosed in the publication is limited in its cooling temperature since the superconducting coil is cooled by the solid refrigerant itself. If solid nitrogen is used, it is difficult to cool a superconducting coil at a temperature lower than approximately 63K which is solid nitrogen temperature.

In all of the above-described cooling methods, the refrigerator employed greatly affects the spatial arrangement, size, usability, cost, and the like of the superconductor apparatus, superconductor equipment, superconductor element, and the like. The structure in which a superconductor is attached to the refrigerator is relatively so large that it is difficult to move the same arbitrarily.

SUMMARY OF THE INVENTION

An object of the present invention is to provide a method of cooling a superconductor easily and rapidly to a lower temperature in a more economic system.

Another object of the present invention is to provide a more compact cooling system that can be moved according to its needs.

A further object of the present invention is to provide a method of cooling easily a superconductor having a higher critical temperature such as an oxide superconductor to a temperature where a higher critical current density is achieved stably in a more economic system.

Still another object of the present invention is to provide a novel cooling method in which a higher current can be conducted to a superconductor stably without quenching.

According to an aspect of the present invention, a cooling method of generating and maintaining a superconducting state for a superconductor is provided. The cooling method includes the steps of attaching a superconductor to a cooling stage of a refrigerator, cooling the superconductor by bringing the superconductor on the cooling stage in contact with a coolant, and further cooling the superconductor by the refrigerator under a state where the superconductor is in contact with the coolant.

In the present invention, the step of further cooling the superconductor by the refrigerator may include the step of solidifying the coolant. In this case, the superconductor can further be cooled by the refrigerator in a state covered with the solidified coolant.

In the present invention, a heater can be provided at or in the neighborhood of the cooling stage. The temperature of the superconductor in contact with the coolant can be adjusted by this heater.

In the present invention, the refrigerator can be a multi-stage type refrigerator including a plurality of cooling stages. Preferably, the superconductor is attached to a cooling stage of which an achievable temperature is lower among the plurality of cooling stages. Further preferably, the superconductor attached to the cooling stage of a lower achievable temperature is in contact with the coolant while the cooling stage having an achievable temperature higher than that of the cooling stage to which the superconductor is attached is not brought into contact with the coolant. By preventing the cooling stage of a higher achievable temperature from forming contact with the coolant, heat invasion from the cooling stage of a higher achievable temperature to the coolant can be suppressed. The cooling operation of a superconductor can be carried out efficiently by the cooling stage of a lower achievable temperature. Herein, the word "lower" refers to "not highest" and the word "higher" refers to "not lowest" as to the achievable temperature of the cooling stages in the multi-stage type refrigerator.

When a multi-stage refrigerator including a plurality of cooling stages is used, the cooling stage of a higher achievable temperature can be used for cooling a heat insulating vessel. In this case, the plurality of cooling stages, the superconductor, and the coolant are housed in the heat insulating vessel. The cooling stage of a higher achievable temperature not in contact with the coolant is connected to an inner wall of the heat insulating vessel via a heat conducting member having a thermal conductivity higher than that of the material forming the inner wall of the heat insulating vessel. The inner wall portion of the heat insulating vessel not in contact with the coolant is cooled down by the cooling stage of a higher achievable temperature via the heat conducting member. Thus, the inner portion of the heat insulating vessel of a relatively higher temperature not in contact with the coolant is cooled down to suppress heat invasion from the heat insulating vessel to the coolant. The heat insulating vessel is preferably formed of stainless steel or fiber reinforced plastic (FRP) such as glass fiber reinforced plastic (GFRP). The heat insulating vessel preferably includes a vacuum insulating layer inside. The heat conducting member connecting the cooling stage of a higher achievable temperature and the inner wall of the heat insulating vessel is formed of a material of good thermal conductivity.

According to the present invention, a superconducting coil that forms, for example, a superconducting magnet, can be cooled. The present invention is applied to cool down a coil formed of an oxide superconducting wire, for example. When the coil is formed of a plurality of stacked pancake coils, a spacer having a groove formed to guide the coolant to the interior of the coil is preferably inserted between the plurality of stacked pancake coils. By using the spacer with a groove, the cooling operation of the coil with a coolant can be carried out more efficiently.

In the present invention, liquid nitrogen can preferably be used for the coolant. Also, the present invention can be applied particularly to cool an oxide superconductor.

According to the cooling method of the present invention, after the solidifying step of the coolant, a current exceeding the level of a critical current value of a superconductor covered with solidified coolant can be conducted to the superconductor within a range where quenching does not occur in the superconductor and where the generated electric resistance can be maintained stably. This method of conducting a current not less than a critical current level is particularly useful in the case where a higher magnetic field is to be generated at the superconductor coil in a short time period or in the case where a superconductor coil is to be operated continuously in a state generating a high magnetic field within a limited time period. Since the temperature of the solidified coolant does not easily rise due to its specific heat capacity (for example, specific heat capacity higher by at least one order than metal), the solidified coolant can be used as a heat sink. Even if heat is generated due to joule heat or by ac loss in the superconductor covered with solidified coolant, the heat is absorbed by the solidified coolant to allow the temperature of the superconductor to be maintained stably. When energization is carried out exceeding the critical current value to result in generation of heat in the superconductor, the generated resistance can be maintained at a low level to continue energization without the occurrence of quenching.

According to another aspect of the present invention, a cooling method includes the steps of accommodating a superconductor within a heat insulating vessel, and filling the heat insulating vessel with a coolant to form contact between the coolant and the superconductor. Furthermore, a heat conducting member in contact with the superconductor and the coolant provided in the heat insulating vessel is brought into contact with a cooling stage of a refrigerator to cool the superconductor and the coolant by thermal conductance via the heat conducting member and the cooling stage. After the coolant is solidified by the cooling operation of the refrigerator, the cooling stage of the refrigerator is detached from the heat conducting member to cease the cooling operation by the refrigerator. The cooled state of the superconductor is maintained by the solidified coolant.

In the cooling method of the present invention, the heat conducting member in contact with the superconductor and the coolant can be constituted by a cooling stage contact unit provided in a cylinder in which a cooling stage of a refrigerator can be inserted in a detachable manner, and a connection unit provided between the contact unit and the superconductor.

In the present invention, liquid nitrogen is preferably used for the coolant. Solid nitrogen is produced by the cooling operation of the refrigerator. The present invention is preferably applicable for the cooling of an oxide superconductor.

The foregoing and other objects, features, aspects and advantages of the present invention will become more apparent from the following detailed description of the present invention when taken in conjunction with the accompanying drawings. BRIEF DESCRIPTION OF THE DRAWINGS FIG. 1 is a schematic diagram showing an apparatus to embody a cooling method of the present invention.

DESCRIPTION OF THE PREFERRED EMBODIMENTS

The present invention can be used to cool various superconductor apparatuses and superconductor equipment employing a superconducting wire such as a superconducting coil of a superconducting magnet, as well as elements using bulky or thin film-shaped superconductors. In the present invention, a superconductor forming these apparatuses or elements is attached to a cooling stage of a refrigerator.

The present invention is particularly applicable to cool a superconductor having a higher critical temperature such as an oxide superconductor. Such oxide superconductors include an yttrium based oxide superconductor such as $Y_1Ba_2Cu_3O_{7-y}(0\leqq y<1)$, a bismuth based oxide superconductor such as $Bi_2Sr_2Ca_1Cu_2O_{8-x}$, $Bi_2Sr_2Ca_2Cu_3O_{10-x}$, $(Bi,Pb)_2Sr_2Ca_1Cu_2O_{8-x}$, $(Bi,Pb)_2Sr_2Ca_2Cu_3O_{10-x}(0\leqq X<1)$, and a thallium based oxide superconductor such as $Tl_2Sr_2Ca_1Cu_2O_{8-z}$, $Tl_2Sr_2Ca_2Cu_3O_{10-z}(0\leqq Z<1)$.

Specific examples of the present invention will be described hereinafter.

Figure 1:
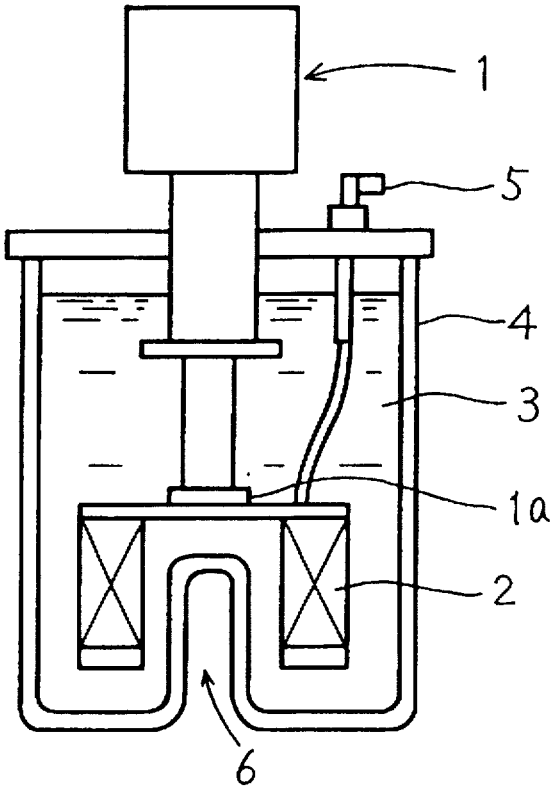

FIG. 1 shows a specific structure of an apparatus for cooling according to the present invention. In this apparatus, a high temperature superconducting coil 2 in which an oxide superconducting wire is coiled, for example, is attached to a cooling stage 1*a* of a refrigerator 1. The cooling stage of refrigerator 1 to which superconducting coil 2 is attached is housed in a vacuum vessel 4. Vacuum vessel 4 can include one layer of a heat insulating wall to insulate heat by vacuum. A deep recess providing magnetic field available space 6 is formed in vacuum vessel 4. The cooling stage of refrigerator 1 is supported within vacuum vessel 4. A current lead 5 for power supply is connected to superconducting coil 2. Vacuum vessel 4 in which a cooling stage is accommodated is filled with a coolant 3 such as liquid nitrogen. Liquid coolant 3 can be introduced into vacuum vessel 4 accommodating a superconducting coil. In the present apparatus, superconducting coil 2 attached to cooling stage 1*a* is immersed in liquid coolant 3 to be cooled down to the temperature of the coolant (for example, approximately 77K for liquid nitrogen).

Figure 2:
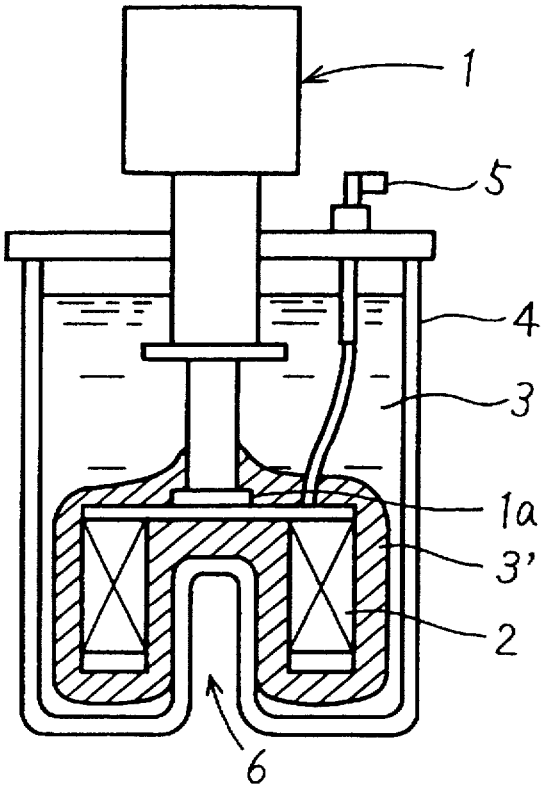
FIG. 2 is a schematic diagram showing a coolant partially solidified in the apparatus of FIG. 1.

Operation of refrigerator 1 is started, whereby the object to be cooled on cooling stage 1*a* is cooled by thermal conduction. When superconducting coil 2 is cooled by refrigerator 1 down to the solid-liquid coexisting temperature of the coolant (for example, 63.1K for liquid nitrogen), solidified coolant (for example, solid nitrogen) is formed around and inside superconducting coil 2 at that temperature. Superconducting coil 2 is now covered with solidified coolant. This state is shown in FIG. 2. Superconducting coil 2 attached to cooling stage 1*a* is covered with solidified coolant 3' (for example, solid nitrogen). This wall of solidified coolant functions as a barrier against heat for the object to be cooled with respect to the external liquid coolant 3. In other words, thermal conduction from liquid coolant 3 to superconductor coil 2 is prevented by solidified coolant 3'. Therefore, the temperature of superconductor coil 2 is further lowered by the cooling operation of refrigerator 1. In the present invention, after the object is rapidly cooled by the liquid coolant, the object can further be cooled down rapidly to a temperature lower than the solidified coolant (for example, 63.1K for solid nitrogen) by the cooling operation of the refrigerator. The cooling of superconducting coil 2 is promoted as the solidified coolant increases. Thus, a lower temperature where superconducting coil 2 has a high critical current density can be achieved more rapidly.

Since the object can initially be cooled down at once by the coolant in the present invention, the cooling time period is reduced significantly in comparison to the case of the conventional cooling method by a refrigerator that effects cooling under a heat insulating state by vacuum. By virtue of the cooling effect by the coolant, the heat insulating structure of the vessel for accommodating the object attached to the cooling stage can be more simple than the heat insulating structure of a conventional refrigerator. Simplification in the structure of the heat insulating vessel provides the advantage that the object such as a superconducting coil can be cooled in a more compact vessel, so that the distance between the superconducting coil and the ambient temperature space is further reduced. In this case, a higher magnetic field can be used effectively.

According to the present invention, cooling can be carried out more speedily using a coolant having a saturated vapor pressure temperature higher than that of liquid helium. In addition to liquid nitrogen, hydrogen, neon, argon, natural gas, ammonia, and the like can be enumerated as the available coolant. Preferably, a coolant having a saturated vapor pressure temperature of 15K–100K under atmospheric pressure can be used. Also, a coolant that is solidified under atmospheric pressure or under decompression at a temperature not more than the critical temperature of the superconductor is preferred. When liquid nitrogen is used for a coolant, the cost for cooling is further reduced in the present invention in comparison to the case where liquid helium is used. Furthermore, the step of further cooling by a refrigerator after cooling by a coolant gives a lower temperature in comparison to the conventional case where cooling is carried out only by nitrogen. By carrying out cooling at a lower temperature for a superconductor having a high critical temperature such as an oxide superconductor, a higher critical current density can be achieved. According to a cooling method using only liquid nitrogen, the temperature is achieved only to the triple point of 63.1K even under decompression. In contrast, a temperature below the triple point of 63.1K can be achieved without decompression by additionally using the refrigerator as in the present invention.

By carrying out the refrigerator cooling to solidify the coolant around the object, the solidified coolant can function as a barrier against heat. Since the thermal conductivity of solid nitrogen is approximately 0.14 W/m.K, an obtained heat insulating effect thereby is not so different from the vacuum heat insulation obtained in a conventional refrigerator. Furthermore, by virtue of the heat capacity of the solidified coolant, heat is consumed during the conversion from solid to liquid even when the object such as a superconductor coil generates heat. The temperature of the object is less easily raised than the case where the surrounding is evacuated. Furthermore, when the superconductor is provided in the form of a coil, the solidified coolant covering the superconductor functions as a reinforcing material with respect to high electromagnet stress to protect the superconducting coil. By the mechanism described above, the electromagnetic stabilization of the superconducting coil is improved.

When liquid nitrogen is used as the coolant, solidified nitrogen can be generated by the cooling operation of the refrigerator under atmospheric pressure. As mentioned before, solid nitrogen functions as a barrier against heat to allow the temperature of the object to be further reduced by the cooling operation of the refrigerator. In this case, the liquid coolant does not have to be solidified entirely. The cooling operation by the refrigerator can be carried out rapidly and effectively as long as a solid of a thickness sufficient to serve as a barrier against heat is formed around the object to be cooled. By solidifying the coolant to an appropriate thickness, the time required for cooling by the refrigerator can be shortened to reduce the load of the refrigerator.

Figure 3:
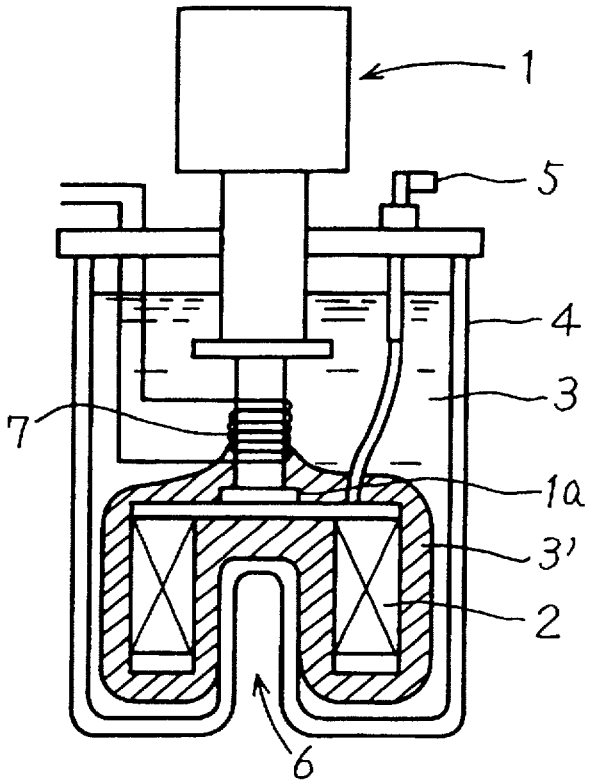
FIG. 3 is a schematic diagram showing another example of an apparatus to embody a cooling method of the present invention.

In the present invention, a heater can be provided at or in the proximity of the cooling stage of the refrigerator. An example of an apparatus with a heater is shown in FIG. 3. The apparatus shown in FIG. 3 has a heater 7 provided on cooling stage 1*a*. The remaining mechanicals are similar to those of the apparatus shown in FIG. 2. By conducting a current to heater 7 for heating under the state where superconducting coil 2 is cooled down to a predetermined temperature by refrigerator 1, the temperature of superconducting coil 2 can be controlled. The temperature of superconductor coil 2 can be raised by increasing the temperature of heater 7. If the heating operation by heater 7 is ceased, superconducting coil 2 returns to the former cooled temperature. The temperature of superconductor coil 2 can be adjusted by controlling the amount of current conducted to heater 7. When liquid nitrogen is used as the coolant and a refrigerator that can cooled to 4.2K is used, the temperature of the object can be maintained at an arbitrary temperature between 4.2K–77K under control of heater 7. In general, a higher temperature of a superconductor results in a lower critical current density thereof. However, by increasing the temperature of the superconductor in an appropriate range, the specific heat capacity is increased to improve the stabilization when energized. An appropriate operation temperature can easily be achieved by adjusting the temperature by the heater.

Figure 4:
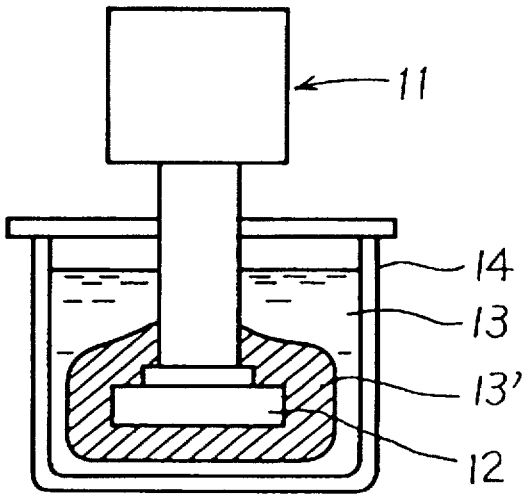
FIG. 4 is a schematic diagram showing another example of an apparatus to embody a cooling method of the present invention.

Although the above embodiment has a high temperature superconducting coil attached to the cooling stage of a refrigerator, the cooling method of the present invention is not limited to cooling a superconducting coil. A bulky superconductor, an element using a thin film-shaped superconductor or the like may be attached to the cooling stage instead of the superconducting coil. FIG. 4 shows a case where a bulky superconductor is cooled. For example, an yttrium based oxide superconductor (YBCO) bulk 12 is attached to a cooling stage 11*a* of a refrigerator 11. YBCO bulk 12 attached to cooling stage 11*a* is housed in a vacuum vessel 14 to be immersed in a coolant 13 such as liquid nitrogen. YBCO bulk 12 cooled down by coolant 13 is further cooled by refrigerator 11, whereby solidified coolant 13' is generated around YBCO bulk 12. By further cooling YBCO bulk 12 covered with solidified coolant 13' of an appropriate thickness according to refrigerator 11, a desired low temperature can be achieved rapidly.

In the present invention, various types of refrigerators can be used depending upon the scale of the required refrigerating capacity. For example, a refrigerator generally called a cryocooler utilizing a cooling storage type refrigerating cycle is preferably used. When a superconductor having a high critical temperature such as an oxide superconductor is to be cooled, a two-stage expansion type refrigerator by Solvay or G-M cycle is preferably used. A commercially available refrigerator of this type can be used for cooling the oxide superconductor down to approximately 10K.

Figure 5:
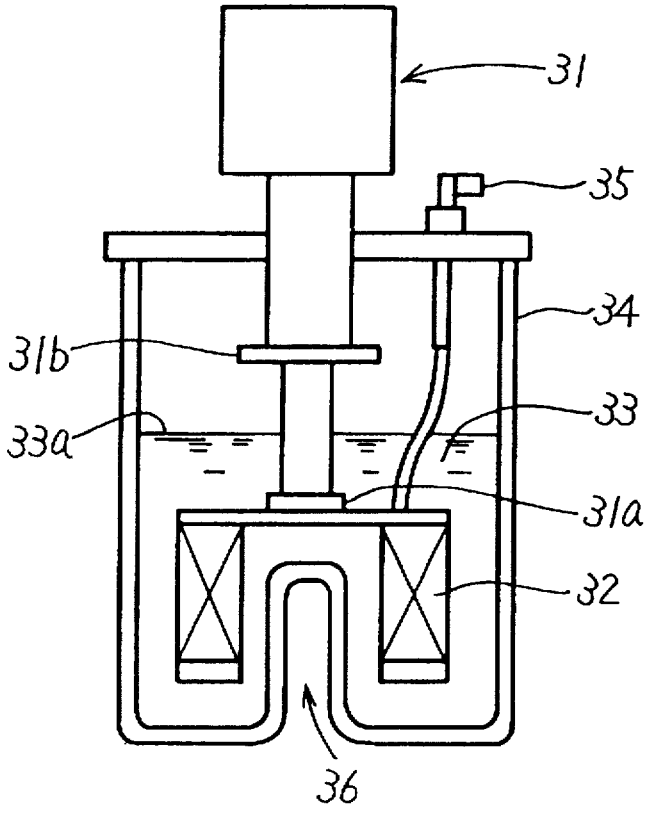
FIG. 5 is a schematic diagram showing an example of an improved apparatus to embody a cooling method of the present invention.
Figure 6:
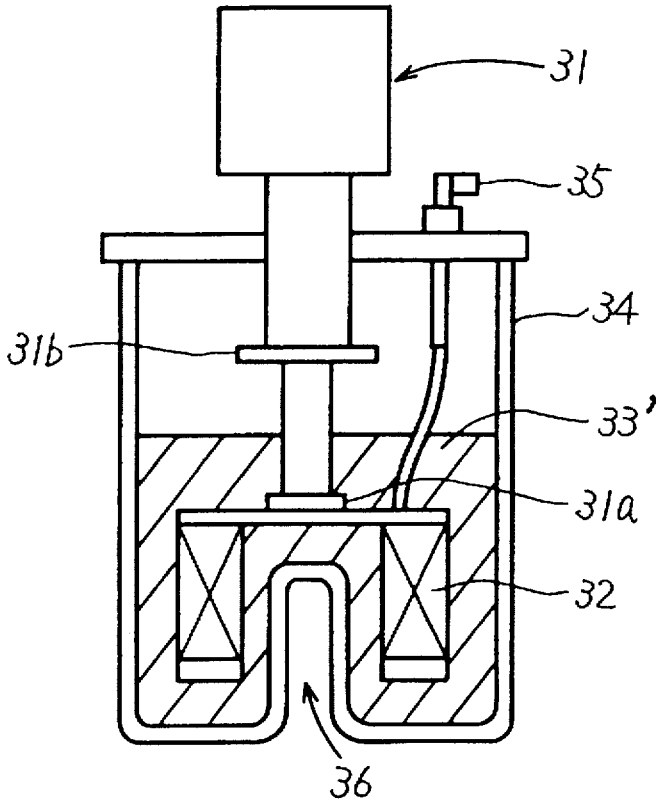
FIG. 6 is a schematic diagram showing a solidified state of a coolant in the apparatus of FIG. 5.

The inventors of the present invention have found that it is preferable to set the surface of the coolant between a cooling stage of a high achievable temperature and a cooling stage of a low achievable temperature when a multi-stage type refrigerator including a plurality of cooling stages is used. Efficient cooling can be carried out by inhibiting contact between the coolant and the cooling stage of a high achievable temperature, and providing contact between the coolant and the superconductor with the cooling stage of a low achievable temperature that directly cools the superconductor. FIGS. 5 and 6 show a specific embodiment thereof. A refrigerator 31 shown in FIGS. 5 and 6 is a two-stage expansion type refrigerator including a first cooling stage 31*b* of a high achievable temperature and a second cooling stage 31*a* of a low achievable temperature. For example, a high temperature superconducting coil 32 of an oxide superconducting wire, is attached to cooling stage 31*a*. The two cooling stages of refrigerator 31 to which coil 32 is attached is housed in a vacuum vessel 34. Vacuum vessel 34 having a vacuum heat insulating layer inside is formed of, for example, stainless steel, or FRP such as glass fiber reinforced plastic (GFRP). Heat invasion from ambient temperature can further be suppressed effectively by forming the vacuum vessel of a material having a low thermal conductance such as GFRP. A deep recess providing magnetic field available space 36 is formed in vacuum vessel 34. A current lead 35 for power supply is connected to superconducting coil 32. Vacuum vessel 34 accommodating two cooling stages is filled with a coolant 33 such as liquid nitrogen. Liquid coolant 33 is introduced into vacuum vessel 34 so that the liquid surface 33*a* thereof is located between first and second cooling stages 31*b* and 31*a*. The liquid surface can be adjusted by using a level gauge (not shown), for example. Therefore, first cooling stage 31*b* is prevented from coming into contact with coolant 33 while second cooling stage 31*a* and superconducting coil 32 are immersed in coolant 33. Under this state, superconducting coil 32 is cooled down to the temperature of coolant 33. Also, vacuum vessel 34 can be evacuated using a vacuum pump (not shown) to lower the temperature of the coolant under decompression. This cooling by decompression can be carried out until the coolant is solidified.

Following the cooling by coolant 33, operation of refrigerator 31 is initiated to cool superconducting coil 32 on second cooling stage 31*a* by thermal conductance. In response to the cooling action by refrigerator 31, superconducting coil 32 and second cooling stage 31*a* are covered with solidified coolant 33' (for example, solid nitrogen) as shown in FIG. 6. The surface of solidified coolant 33' is located between first cooling stage 31*b* and second cooling stage 31*a*. By such adjusting the position of the surface of the coolant, invasion of heat from first cooling stage 31*b* of a high achievable temperature to second cooling stage 31*a* of a low achievable temperature via coolant 33' can be prevented. In a two-stage expansion type refrigerator, the achievable temperature of the first cooling stage can be set to approximately 40K, and the achievable temperature of the second cooling stage can be set to approximately 20K. In this case, location of the surface of the coolant between the first and second stages is significant for the purpose of effectively cooling the superconductor by the second cooling stage having an achievable temperature of approximately 20K.

Figure 7:
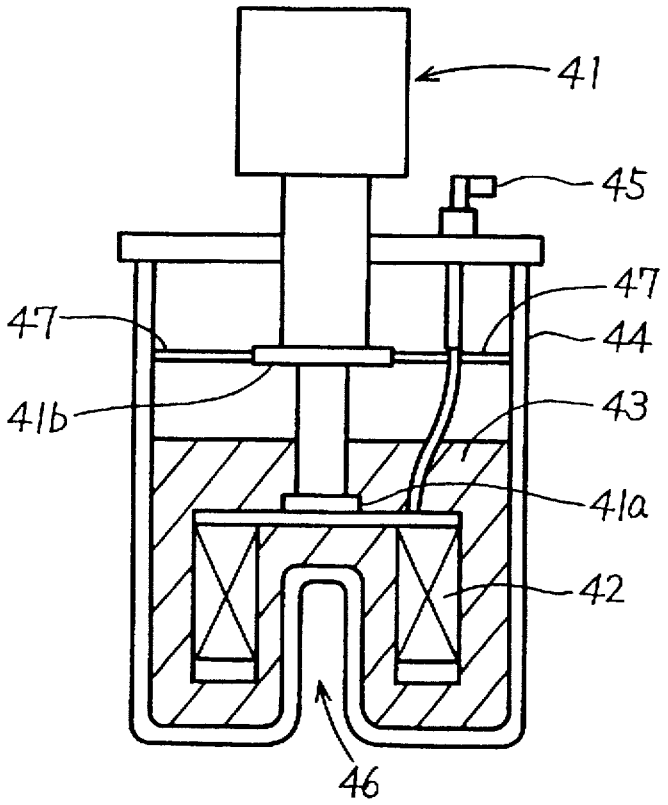
FIG. 7 is a schematic diagram showing another example of an improved apparatus to embody a cooling method of the present invention.

In the cooling method of the present invention, it is desirable to minimize heat invasion to the coolant and the cooling stage that directly cools the superconductor. The inventors of the present invention have found means for effectively preventing heat invasion to the coolant and the object to be cooled. It has been found that, in a multi-stage type refrigerator including a plurality of cooling stages as shown in FIG. 7, the cooling stage of a high achievable temperature may contribute to efficient cooling when it cools a relatively high temperature portion of the vessel which accommodates the coolant and the object to be cooled. In FIG. 7, a first cooling stage 41*b* of a high achievable temperature of a two-stage expansion type refrigerator 41 is preferably connected to an inner wall of a heat insulating vessel 44 via a heat conducting member 47. Heat conducting member 47 is formed of a material having a thermal conductivity higher than that of the material forming the inner wall of heat insulating vessel 44. Heat conducting member 47 is preferably formed of a material of good thermal conductance such as copper, aluminum, silver, or gold. Heat conducting member 47 can be connected to first cooling stage 41*b* by a screw or the like, and brought into contact with the inner wall of heat insulating vessel 44 by compression bonding, or the like. Heat conducting member 47 is not particularly limited in configuration. A circular flat plate, corrugated sheet, wire netting or the like can be used. Heat conducting member 47 may have a through hole for transmitting vaporized coolant. In the present case, a vacuum vessel having an inner vacuum heat insulating layer can be used for heat insulating vessel 44. The material thereof is, for example, stainless steel, or FRP such as GFRP. The surface of coolant 43 is located between first cooling stage 41*b* and second cooling stage 41*a* as shown in FIG. 7. The upper portion of heat insulating vessel 44 not in contact with coolant 43 has a relatively high temperature due to heat invasion from ambient temperature. By connecting the portion of the inner wall of heat insulating vessel 44 not in contact with coolant 43 to first cooling stage 41*b* via heat conducting member 47, the heat of that portion is preferentially conducted to cooling stage 41*b* via heat conducting member 47 formed of a material of high thermal conductance to suppress heat invasion towards coolant 43 via the inner wall of vessel 44. In the above structure, the cooling stage of a high achievable temperature contributes to effective cooling by suppressing heat invasion to the coolant.

For the purpose of further suppressing heat invasion, a cap for the heat insulating vessel accommodating the cooling stage and the object may have a heat insulating structure including a vacuum heat insulating layer or another heat insulating material. Also, a member to suppress radiation or a heat insulating member can be provided in the cavity of the heat insulating vessel accommodating the cooling stage and the object to be cooled. A heat insulating resin such as urethane foam can be used as the heat insulating material. A corrugated sheet formed of stainless steel can be used as a heat shield.

Figure 8:
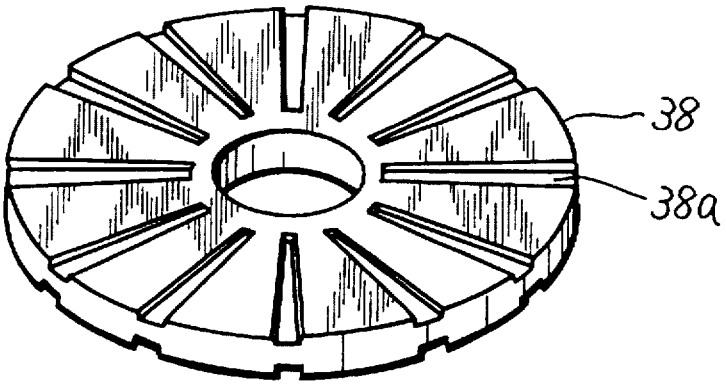
FIG. 8 is a perspective view of a spacer for a superconducting coil used in the present invention.
Figure 9:
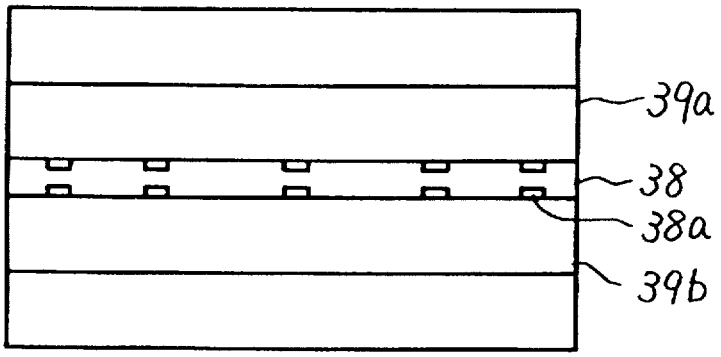
FIG. 9 is a side view showing a spacer inserted between pancake coils.
Figure 10:
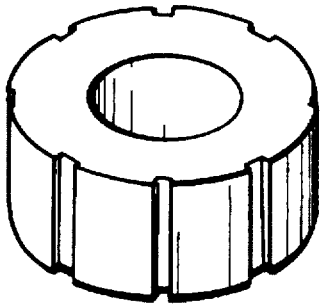
FIG. 10 is a perspective view showing an example of a winding frame for a coil used in the present invention.

In cooling a superconducting coil, a spacer 38 as shown in FIG. 8 is preferably inserted between the coils. Spacer 38 has a plurality of grooves 38*a* formed in a radial manner at the top surface and back surface thereof. The size of groove 38*a* is selected so as to allow smooth introduction of a coolant therethrough. As shown in FIG. 9, spacer 38 having a plurality of grooves 38*a* is inserted between double pancake coils 39*a* and 39*b*. In a superconducting coil having pancake coils stacked, the insertion of such a spacer 38 between the coils provides the advantage that the coolant can be introduced into the interior of the coil via groove 38*a*. The coolant can be present inside the coil via groove 38*a* in either a liquid or solid state. By using the spacer of the above-described structure, the coil can be cooled further efficiently. A former in which a plurality of grooves are formed as shown in FIG. 10 can be used for the coil to introduce the coolant inside.

As will be shown more specifically in an embodiment described afterwards, the inventors of the present invention have found that, in a state where a superconductor (for example, a superconducting coil) is covered with a solidified coolant (for example solid nitrogen), a current greater than the critical current value can be conducted stably without generation of quenching as long as the current is within a predetermined range. It is presumed that the solidified coolant functions as a heat sink due to its high specific heat capacity, whereby increase in temperature is retarded by virtue of the solidified coolant around the superconductor even when the superconductor generates joule heat or ac loss heat. By a similar principle, invasive external heat is effectively absorbed by the solidified coolant. Covering a superconductor with solidified coolant provides the advantage of facilitating temperature control of the superconductor in comparison to the case where the superconductor is cooled by a refrigerator without any coolant, and also the advantage of allowing the superconductor to be operated by a greater current due to the function as a heat sink.

EXAMPLE 1

Figure 11:
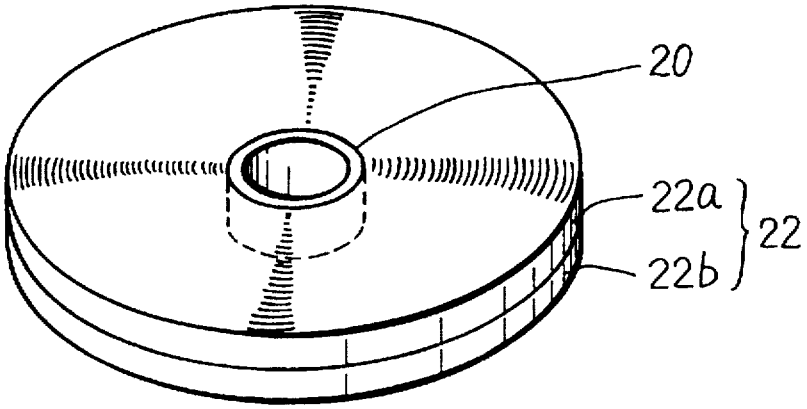
FIG. 11 is a perspective view of a superconducting coil used for cooling in the present invention.

A double pancake type superconducting coil was produced using an oxide superconducting wire which consists of a bismuth based oxide superconductor covered with a silver sheath. The used wire had a width of 3.5 mm and a thickness of 0.24 mm. Three layered wires of 3 m in length were wound around a copper ring having a height of 7.5 mm and an outer diameter of 60 mmϕ to obtain a pancake type superconducting coil as shown in FIG. 11. The coil of FIG. 11 had two layers of pancake coils 22*a* and 22*b* formed of the superconductor wires provided around copper ring 20. A polyimide tape of 15 μm in thickness was used as the electric insulating material of the coil. The polyimide tape was wound together with the three layered wires.

Figure 12:
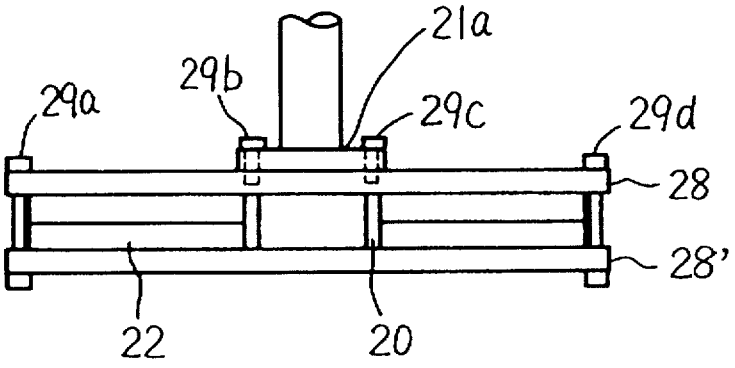
FIG. 12 is a schematic diagram showing a superconductor coil attached to a cooling stage of a refrigerator in an embodiment.

The produced double pancake type superconducting coil was attached to the second cooling stage of a GM refrigerator. The GM refrigerator had a capacity of 30 W at 80K in the first cooling stage and 4 W at 20K in the second cooling stage. The superconducting coil was attached to the cooling stage as shown in FIG. 12. Superconducting coil 22 was sandwiched by two copper plates 28 and 28' to be fixed to a copper-made second cooling stage 21*a* by screws 29*a*, 29*b*, 29*c* and 29*d*. The entire superconducting coil 22 was cooled by second cooling stage 21*a* via the copper plates.

Figure 13:
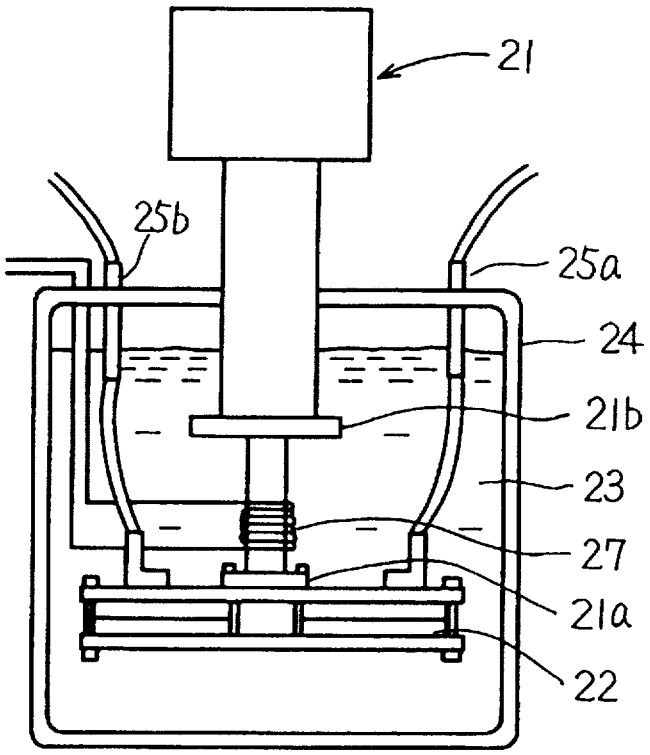
FIG. 13 is a schematic diagram showing an apparatus for cooling a superconducting coil in an embodiment of the present invention.

A heater wire was wound between the first and second cooling stages of the refrigerator. A current lead was connected so as to supply power to the superconducting coil. Then, the first and second cooling stages of the refrigerator were inserted and supported in a vessel containing liquid nitrogen as shown in FIG. 13. Two cooling stages 21*a* and 21*b* of refrigerator 21 were immersed in liquid nitrogen 23. The cooling stages were heated by energizing heater wire 27 wound between the two cooling stages. Power was supplied to superconducting coil 22 from current leads 25*a* and 25*b*. A vacuum vessel of a simple structure was used for vessel 24 accommodating liquid nitrogen 23. By the immersion in liquid nitrogen, superconducting coil 22 was rapidly cooled down to approximately 77K which is the temperature of liquid nitrogen.

Figure 14:
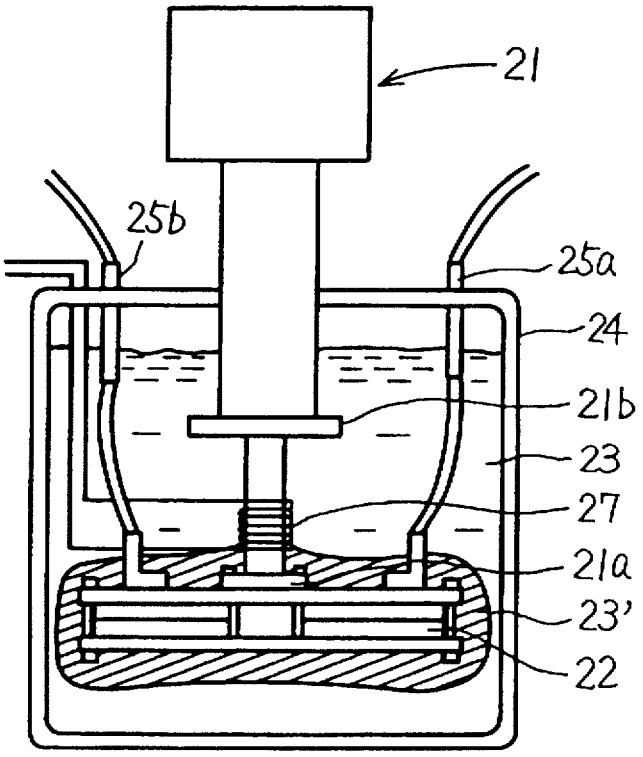
FIG. 14 is a schematic diagram showing liquid nitrogen partially solidified in the apparatus of FIG. 13.

Then, the operation of refrigerator 21 was initiated to cool down superconducting coil 22 by second cooling stage 21*a*. When the temperature of the liquid nitrogen under atmospheric pressure reaches 63.2K, solid nitrogen began to be generated around superconducting coil 22. FIG. 14 shows the state where the superconducting coil is covered with solid nitrogen. Liquid nitrogen 23 is partially solidified to form solid nitrogen 23' around superconducting coil 22. The temperature of coil 22 was lowered down to the level of 20K by the cooling operation of refrigerator 21. At this time, the temperature of liquid nitrogen 23 was approximately 64K. Upon energizing superconducting coil 22 at the temperature of 20K, the critical current thereof became as high as 130 A.

Figure 15:
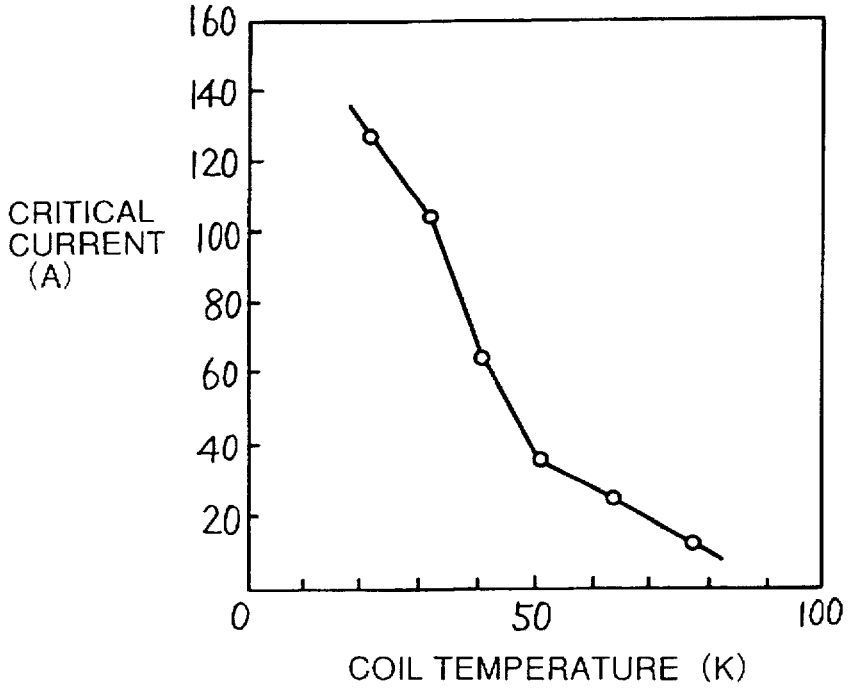
FIG. 15 shows the relationship between the cooling temperature and critical current value of the coil obtained in an embodiment of the present invention.
Figure 16:
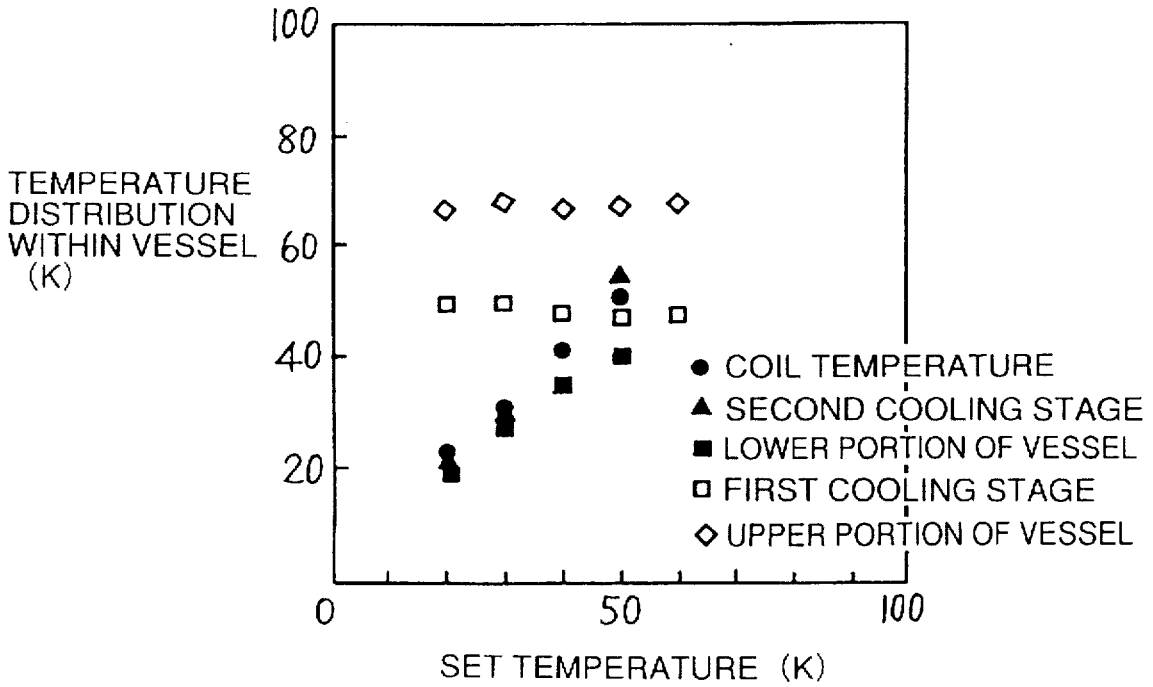
FIG. 16 shows the temperature of various portions in the apparatus used in an embodiment of the present invention.

The critical current value of the superconducting coil was examined altering the temperature of the second cooling stage using the heater under a state where cooling is carried out by a refrigerator. Change in the critical current value of the superconducting coil in response to a change in the temperature of the second cooling stage from 20K to 77.3K is shown in FIG. 15. The corresponding temperature distribution is also shown in FIG. 15. The temperature distribution was measured by providing thermocouples respectively at superconductor coil 22, second cooling stage 21*a*, the lower portion of vessel 24, first cooling stage 21*b*, and the upper portion of vessel 24. The coil temperature shown in FIG. 15 was measured by the thermal thermocouple provided at superconducting coil 22. The critical current value of the superconducting coil was defined as the current across the voltage terminals at respective ends of the coil where the resistance of the coil was $10^{-13}$ Ω.m. As shown in FIG. 16, the temperature at the first cooling stage and the temperature at the upper portion of the vessel were substantially constant at 64K and 50K, respectively. The temperature of the coil could be adjusted in the range of 20K–64K by the heater set between 0–30 W. The critical current value was 13.5 A when the coil temperature was equal to the temperature of liquid nitrogen (77.3K). When the coil temperature was reduced to 20K, the critical current value became as high as 130 A. According to the present invention, the superconducting coil could be rapidly cooled and the critical current value could be increased to approximately 10 times. As shown in FIG. 16, the coil temperature and the temperature of the second cooling stage could be altered by the heater at substantially the same rate. This implies that an arbitrary temperature can be achieved by the control using a heater within the range from the lowest temperature that can be achieved by the refrigerator to the temperature of the liquid nitrogen.

EXAMPLE 2

A double pancake type superconducting coil was produced using an oxide superconducting wire which consists of a bismuth based oxide superconductor covered with a silver sheath. The wire had a width of 3.5 mm and a thickness of 0.24 mm. One line of wire 50 m in length was coiled around a copper ring having a height of 7.5 mm and an outer diameter of 40 mmϕ to obtain a pancake type superconducting coil. A polyimide tape of 15 μm in thickness was used as an electric insulating material of the coil.

12 pancake coils each obtained as described above were stacked via a spacer of 1 mm in thickness having a configuration as shown in FIG. 8 to obtain a superconducting coil for testing.

Figure 17:
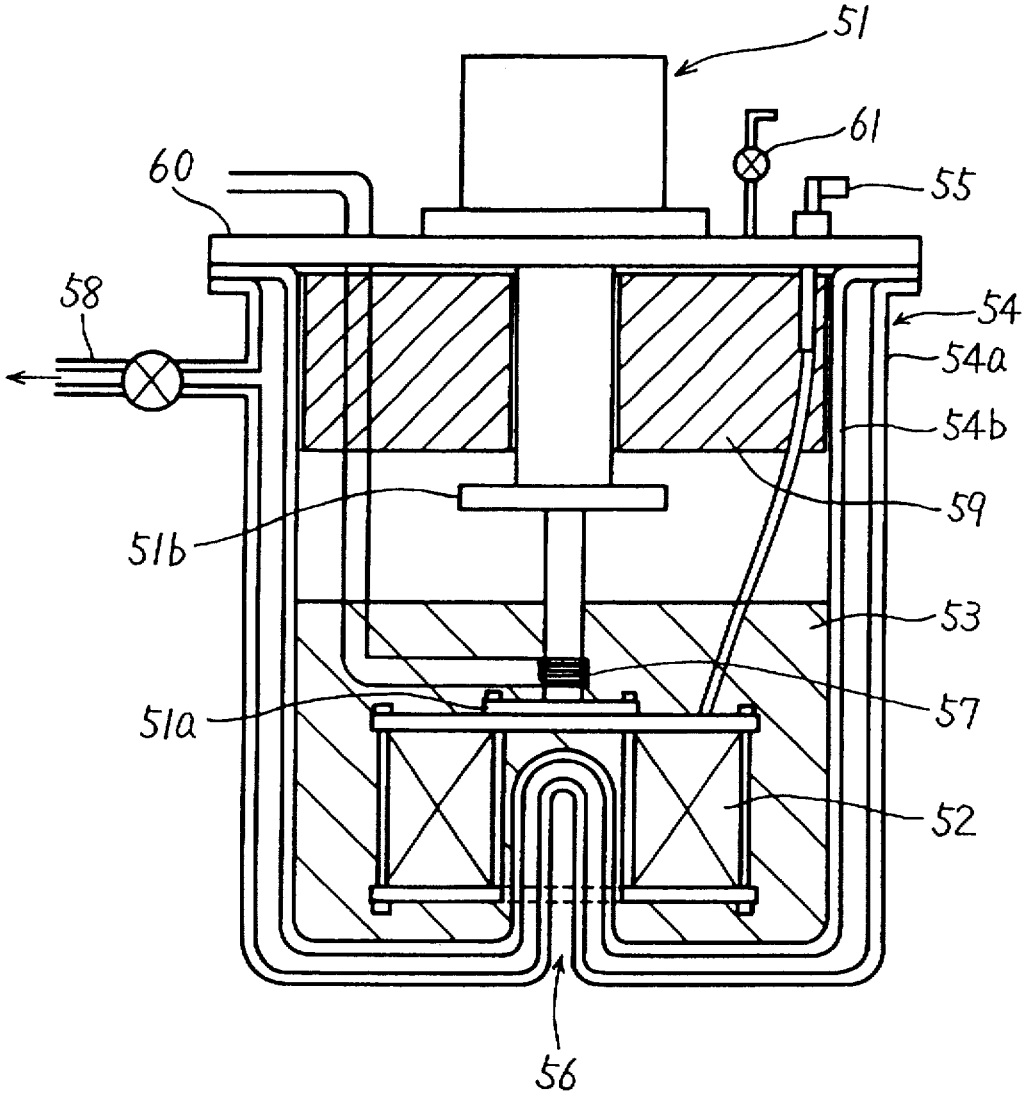
FIG. 17 is a schematic diagram showing another apparatus used to cool a superconducting coil according to an embodiment of the present invention.

The obtained superconducting coil was attached to an apparatus shown in FIG. 17. A GM refrigerator which is a two-stage expansion type refrigerator was used. The cooling capacity of the first cooling stage was 10 W at 40K, and the cooling capacity of the second cooling stage was 4 W at 20K. Referring to FIG. 17, a superconducting coil 52 was fixed to a second cooling stage 51*a*. Superconducting coil 52 was sandwiched between two copper plates to be fixed by screws to the copper-made second cooling stage 51*a*. An indium sheath was inserted between the copper plate and the second cooling stage.

A heater wire 57 was wound in the proximity of second cooling stage 51*a* of the refrigerator. A current lead 55 for supplying power to superconducting coil 52 was further connected. First and second cooling stages 51*b* and 51*a* of refrigerator 51 and superconducting coil 52 fixed thereto were placed in a vacuum vessel 54. The opening of vessel 54 was closed with a cap 60. Vacuum vessel 54 had an outer wall 54*a* and an inner wall 54*b* having a deep concave to form magnetic field available space 56. A vacuum heat insulating layer was formed between outer and inner walls 54*a* and 54*b* by evacuation through a pipe 58 with a valve. The outer and inner walls 54*a* and 54*b* of vacuum vessel 54 are made of stainless steel or GFRP. A heat insulating material 59 formed of urethane foam was provided above first cooling stage 51 prior to sealing the opening of vacuum vessel 54 with cap 60. Heat insulating material 59 serves to prevent heat invasion via cap 60. A decompression valve 61 was provided at cap 60 to prevent the pressure in vacuum vessel 54 from rising to an abnormal level. Following the formation of a vacuum heat insulating layer by evacuation in vacuum vessel 54, liquid nitrogen was introduced into vessel 54 through an inlet (not shown) provided at cap 60. The amount of liquid nitrogen introduced was selected so that the liquid surface of the liquid nitrogen was located between first cooling stage 51*b* and second cooling stage 51*a*. Then, a sealed state was established with cap 60. Superconducting coil 52 was rapidly cooled down to approximately 77K by the liquid nitrogen.

Then, operation of refrigerator 51 was initiated to further cool down superconducting coil 52 by thermal conduction through second cooling stage 51*a*. Solid nitrogen began to form around superconducting coil 52 when the temperature of the liquid nitrogen became 63.2K under atmospheric pressure. In a while, superconducting coil 62 was covered with solid nitrogen 53 which was generated by partial or entire solidification of the liquid nitrogen. Then, superconducting coil 52 was further cooled down rapidly to 20K by the cooling operation of refrigerator 51.

Figure 18:
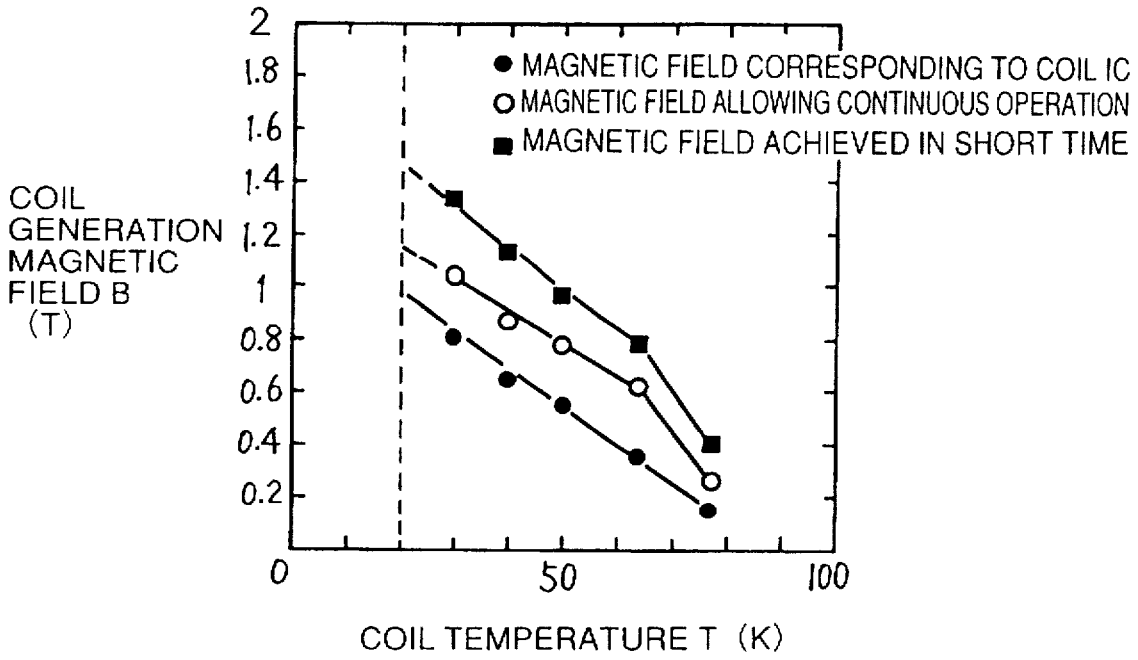
FIG. 18 shows the relationship between coil temperature and coil generated magnetic field when a current not less than the level of the critical current value is conducted to the coil.

The critical current value of superconducting coil was measured with different temperatures of second cooling stage 51*a* by heater 57 under a state where cooling was carried out by refrigerator 51. In the usual way, the critical current value of the superconducting coil was defined as the current across the voltage terminals at both ends of the coil when the resistance was $10^{-13}$ Ω.m. Then, the temperature of second cooling stage 51*a* was altered using heater 57 to conduct currents equal to and above the critical current value level to superconducting coil 52. It was found that quenching did not occur in the coil even when a current that is approximately 1.2 times as high as the critical current value was continuously conducted for 1 hour. It was further found out that no quenching occurred in the coil even when a current approximately 1.5 times higher than the critical current value was conducted for 5 minutes. Thus, it was found that energization could be carried out stably while maintaining the generated electric resistance at a constant level even when the coil was operated for a predetermined time by a current of these values. The fact that the coil resistance is not so greatly increased even when the coil is partially rendered normal conducting is probably due to the cooling action of solid nitrogen. The achieved result is shown in FIG. 18. In FIG. 18, the solid circle indicates the intensity of the magnetic field generated when a critical current value is conducted to the coil. The open circle indicates the coil generated magnetic field when one hour of operation was allowed with a current more than the critical current value. The solid rectangle indicates the magnetic field of the coil obtained in 5 minutes under a higher current value. From the results, it was found that the method of the present invention for cooling a coil by a cooling stage with the superconductor coil covered with solid nitrogen is effective in generating a high magnetic field in a short time, for example in the case of generating a pulse magnetic field, and also effective to suppress quenching and to improve stabilization of the coil.

Figure 19:
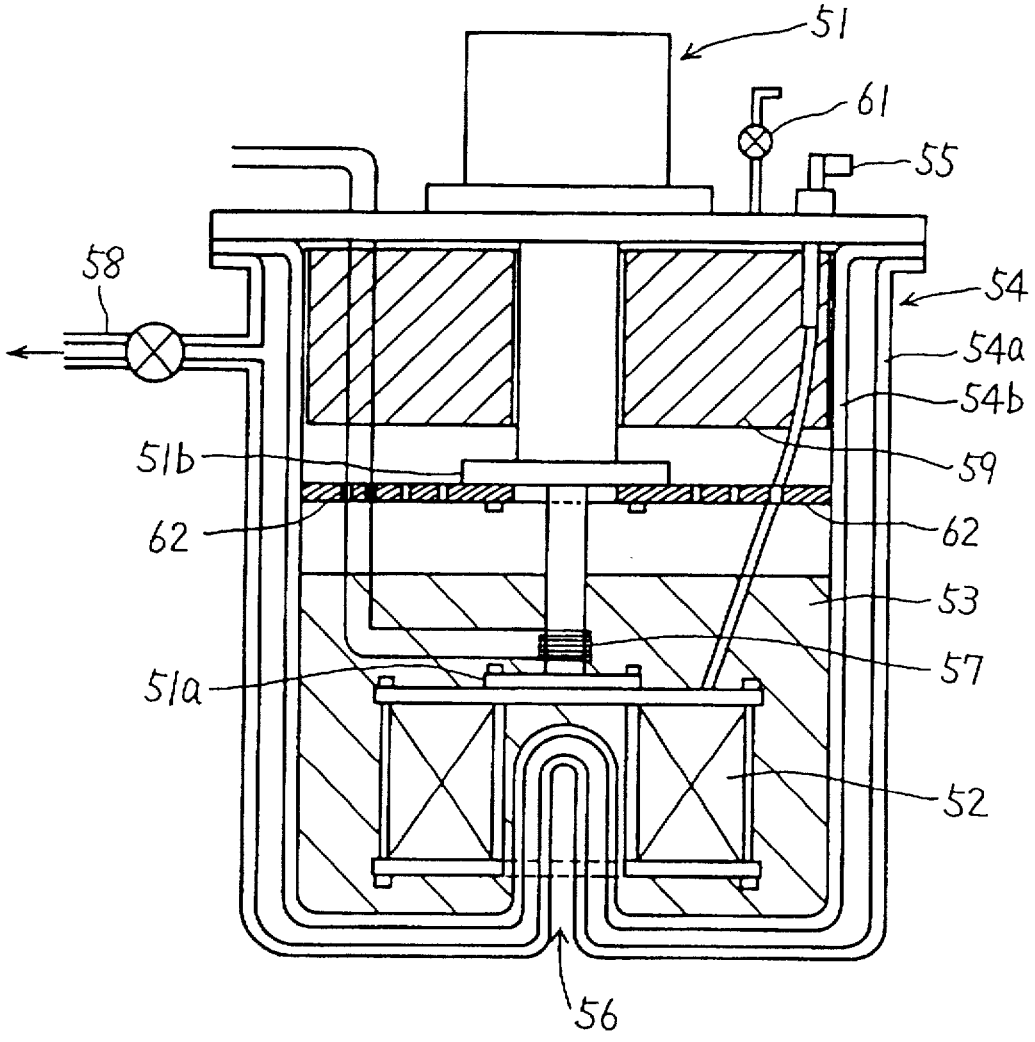
FIG. 19 is a schematic diagram showing another example of an apparatus used in an embodiment of the present invention.

An apparatus as shown in FIG. 19 was assembled. The apparatus of FIG. 19 is similar to the apparatus of FIG. 17 except that a heat conducting member 62 is provided between first cooling stage 51b and the inner wall 54*b* of vacuum vessel 54. Heat conducting member 62 is a copper disk with a plurality of through holes. The center portion of heat conducting member 62 is screwed to first cooling stage 51*b*. When inner wall 54*b* of vacuum vessel 54 is formed of stainless steel, the perimeter of heat conducting member 62 is welded to inner wall 54*b*. When inner wall 54*b* is formed of GFRP, the perimeter of heat conducting member 62 is attached by compression to inner wall 54*b*. In the apparatus of FIG. 19, the upper portion of inner wall 54*b* can be effectively cooled by cooling stage 51*b* via heat conducting member 62. Heat invasion from inner wall 54*b* to solid nitrogen or a coolant consisting of two phases of liquid and solid nitrogen 53 can be reduced. This is apparent from the reduction in the time required for superconducting coil 52 to be cooled down to a predetermined temperature by second cooling stage 51*a*.

The apparatus as shown in FIG. 19 was examined for a characteristic in a pulse operation. The conditions for the pulse excitation were as follows:

| Initial Temperature | |
|---|---|
| at Vessel Bottom | 23 K. |
| at Lower Portion of Coil | 23 K. |
| at Upper Portion of Coil | 23 K. |
| Second Stage Temperature | 23 K. |
| 1st Stage Temperature | 41 K. |
| Current | 30 A |
| Generated Magnetic Field | 1.0 T |
| Generated Coil Voltage | 2.0 mV |
| Number of Operation Cycles | 150 |

Figure 20:
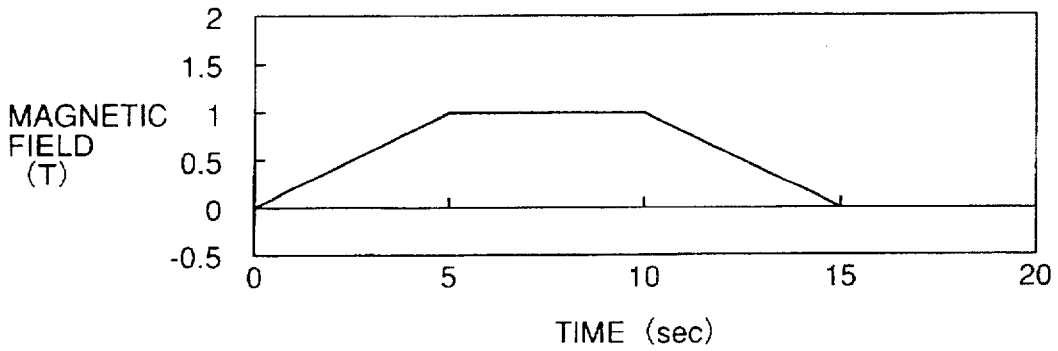
FIG. 20 is a diagram showing the pattern of one cycle of a pulse magnetic field generated in the apparatus as shown in FIG. 19.
Figure 21:
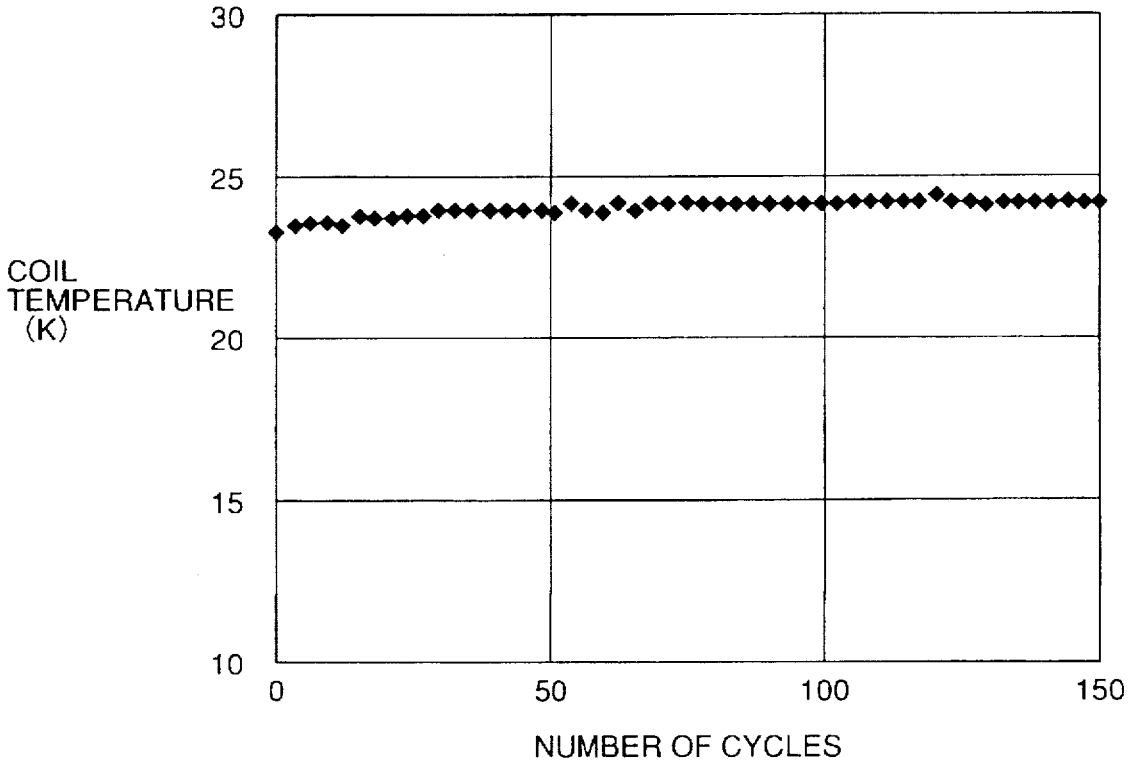
FIG. 21 is a chart showing the coil temperature in the 150 cycles of the pulse magnetic field generated in the apparatus as shown in FIG. 19.

FIG. 20 shows the pattern of one cycle of the generated pulse magnetic field. The result of the pulse operation of 150 cycles is shown in FIG. 21, which demonstrates the increased temperature of the coil was only about 1K and a stable operation was performed in the 150 cycles. The ac loss of the coil was estimated at about 2.5 W. Since the increased temperature in the case that the solid nitrogen is not generated may be calculated at about 7 K according to a heat map in the refrigerator, it is concluded that the increase in the temperature of the excited coil was suppressed by virtue of the specific heat capacity of solid nitrogen.

Additionally, the operation of the refrigerator was ceased after the solid nitrogen was generated in the apparatus as shown in FIG. 19. In such a state, the apparatus was examined for an operation characteristic of the coil. The conditions for the excitation after the stop in the refrigerator cooling were as follows:

| Initial Temperature | |
|---|---|
| at Vessel Bottom | 20 K. |
| at Lower Portion of Coil | 20 K. |
| at Upper Portion of Coil | 20 K. |
| Second Stage Temperature | 20 K. |
| 1st Stage Temperature | 41 K. |
| Current | 21 A |
| Generated Magnetic Field | 0.7 T |
| Generated Coil Voltage | 1.2 mV |
| Time Period for Excitation | 8 hours |

Figure 22:
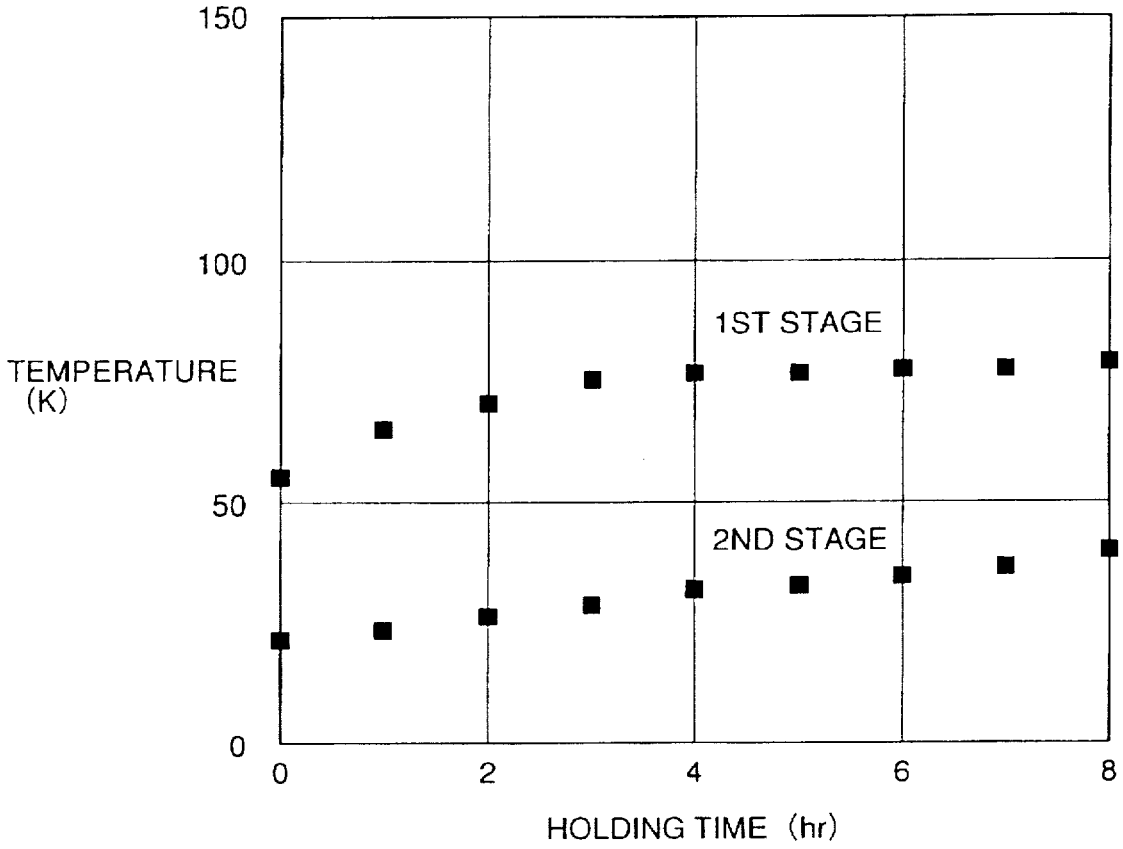
FIG. 22 is a chart showing the relationship between the excitation time period and the cooling stage temperature after the refrigerator operation is ceased in the apparatus as shown in FIG. 19.

As a result, the coil could be excited for 8 hours to generate 0.7 T of a magnetic field. FIG. 22 shows the relationship between the excitation time period and the cooling stage temperature.

Figure 23:
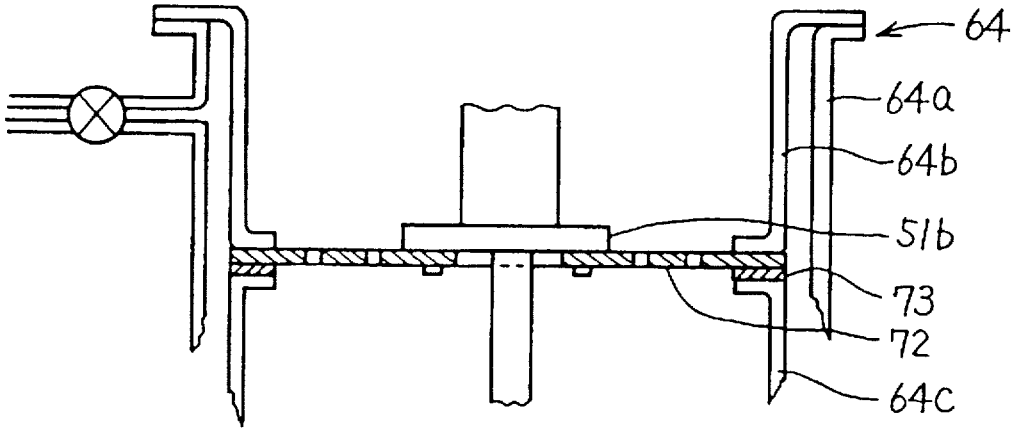
FIG. 23 is a schematic diagram showing another structure for attaching a thermal conducting member.

The heat conducting member can be attached according to a structure as shown in FIG. 23. A heat conducting member 72 with a through hole is joined to an inner wall upper portion **64*b* that forms vacuum vessel 64 together with an outer wall 64*a*, and is further connected to an inner wall lower portion 64*c* via a seal member 73 with bolts or the like. This structure provides the advantage that heat invasion to inner wall 64*c*** in contact with the coolant can be further reduced.

Various means can be taken to further suppress heat invasion in the apparatus shown in FIGS. 17 and 19. For example, the cap sealing of the vacuum vessel can have a structure including a vacuum heat insulating layer or other heat insulating materials. Also, a heat blocking member for blocking heat radiation can be provided between the first cooling stage and the cap. The superconductor can be cooled more rapidly by evacuating the capped vessel with a vacuum pump after the vessel is filled with liquid nitrogen, to achieve a decompressed state for a supercooling state until liquid nitrogen is solidified. The amount of liquid nitrogen to be charged should be determined taking the amount reduced by the vacuum pump evacuation into account.

Figure 24:
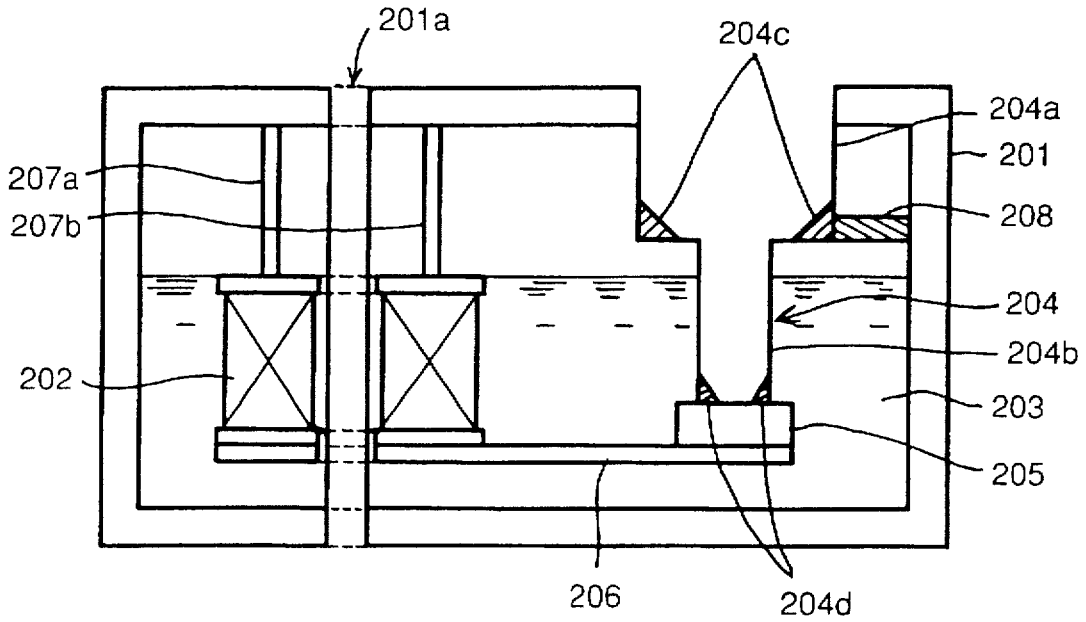
FIG. 24 is a schematic diagram of a further example of an apparatus to embody a cooling method of the present invention.

Another specific example of the present invention will be described hereinafter. Referring to FIG. 24, an apparatus for cooling according to the present invention accommodates a superconducting coil 202, which is the superconductor to be cooled, within a heat insulating vessel 201. Heat insulating vessel 201 is, for example, a vacuum vessel having an internal heat insulating vacuum layer. A through hole **201*a* providing magnetic field available space is formed in heat insulating vessel 201. Superconducting coil 202 is a high temperature superconducting coil having an oxide superconducting wire wound, for example. Superconducting coil 202 is held inside heat insulating vessel 201 by supporting rods 207*a* and 207*b*. A cylinder unit 204 is inserted in heat insulating vessel 201 maintaining its sealed structure. Cylinder unit 204 has a structure in which a first cylinder 204*a* of a greater diameter is joined to a second cylinder 204*b* of a smaller diameter. A copper-made first ring 204*c* having a tapered hole is provided at an end of first cylinder 204*a*. First ring 204*c* is connected to the inner wall of heating insulating vessel 201 by a copper heat conducting member 208. A copper-made second ring 204*d* having a tapered hole is provided at an end of second cylinder 204*b*. Second ring 204*d* is connected to copper-made cylindrical member 205. A copper-made heat conducting plate 206 is provided between cylindrical member 205 and superconducting coil 202. Superconducting plate 206 has one end joined to superconducting coil 202 by screws or the like, and the other end connected to cylinder 205 by screws or the like. Good thermal conduction between superconducting coil 202 and second ring 204*d* is achieved by means of copper cylindrical member 205 and copper heat conducting plate 206. The material of first ring 204*c*, heat conducting member 208, second ring 204*d*, cylindrical member 205 and heat conducting plate 206 is not particularly limited to copper as described above and can be an arbitrary material as long as it has good heat conductance. Therefore, the components can be made of other heat conducting materials such as aluminum, silver, and gold. Copper rings 204*c* and 204*d* can have a flexible structure composed of a material having good thermal conductance such as copper to facilitate attachment/detachment of the cooling stage as will be described afterwards. A coolant such as liquid nitrogen is introduced into the apparatus of the above-described structure. In cooling an oxide superconductor, liquid nitrogen is a favorable coolant. The surface of coolant 203 introduced in heat insulating vessel 1 is adjusted so as to avoid contact with first ring 204*c* of first cylinder 204*a*. More specifically, the surface of coolant 203 (the surface of liquid nitrogen) is set between first ring 204*c* and second ring 204*d*. Superconducting coil 202 is entirely immersed in coolant 203. Second ring 204*d*, cylindrical member 205, heat conducting plate 206 are also immersed in coolant 203. According to the present apparatus, superconducting coil 202** is cooled down to the temperature of the coolant (for example, approximately 77K for liquid nitrogen).

Figure 25:
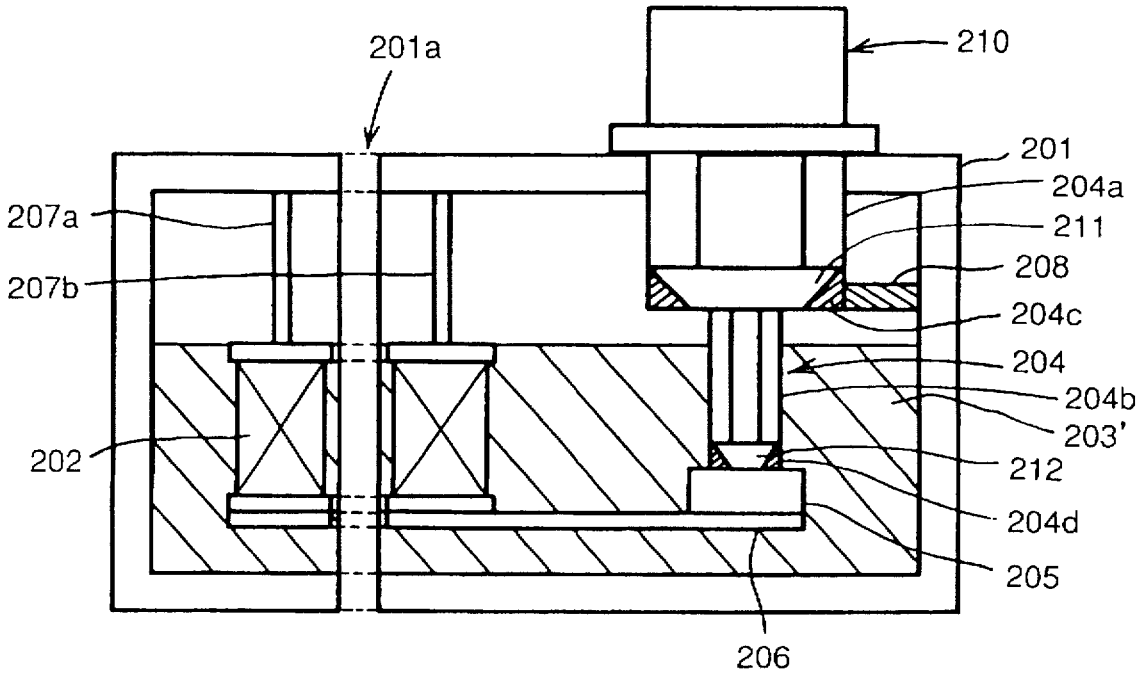
FIG. 25 is a schematic diagram showing a refrigerator installed in the apparatus of FIG. 24 with the coolant solidified.

Referring to FIG. 25, a cooling stage of a refrigerator 210 is inserted into cylinder 204. Refrigerator 210 is a two-stage expansion type GM refrigerator, for example. Refrigerator 210 has a first cooling stage 211 of a high achievable temperature of approximately 40K, and a second cooling stage 212 of a low achievable temperature of approximately 20K. First cooling stage 211 is inserted in first cylinder **204*a*** to come into contact with copper first ring 204*c* provided at one end of first cylinder 204*a*. Second stage 212 is inserted into second cylinder 204*b* to come into contact with copper second ring 204*d* provided at one end of second cylinder 204*b*. The two cooling stages 211 and 212 are formed in a tapered configuration to facilitate the attachment of the cooling stage along the copper ring. First cooling stage 211 in contact with the first ring 204*c* can cool the upper portion of the inner wall of heat insulating vessel 201 via heat conducting member 208. By the cooling operation of first stage 211, heat invasion into the coolant via the inner wall of heat insulating vessel 201 is suppressed. Second cooling stage 212 in contact with second ring 204*d* can cool superconducting coil 202 by thermal conduction via cylindrical member 205 and heat conducting plate 206. Cylindrical member 205 and heat conducting plate 206 function as a member to connect second cooling stage 212 in contact with the second ring 204*d* and superconducting coil 202 for thermal conductance.

Upon operation of refrigerator 210, the upper portion of the inner wall of heat insulating vessel 201 is cooled down by first cooling stage 211, and superconducting coil 202 is cooled by second cooling stage 212 via cylindrical member 205 and plate 206. The direct cooling of the coolant (liquid nitrogen) is also carried out by second cooling stage 212 via super conducting coil 202, heat conducting plate 206, and cylindrical member 205. Accordingly, super conducting coil 202 can be cooled down to the achievable temperature of refrigerator 210. Also, the coolant can be cooled so as to be solidified. FIG. 25 shows superconducting coil 202 covered with partially or entirely solidified coolant (for example, solid nitrogen or two phase coolant of solid and liquid nitrogen) 203'. Superconducting coil 202 cooled down to a lower temperature by refrigerator 210 is supplied with power via a current lead (not shown). Superconducting coil 202 can have a critical current density significantly higher than the case cooled by a liquid coolant (for example, liquid nitrogen). The partially or entirely solidified coolant 203' has a high specific heat capacity so as to be able to function as a heat sink for superconducting coil 202. The temperature of superconducting coil 202 covered with partially or entirely solidified coolant 203' does not easily rise even when joule heat or ac loss heat is generated. Therefore, the operation of superconducting coil 202 is further stabilized by partially or entirely solidified coolant 203' to result in a significant suppression of quenching. Thus, a greater current can be conducted to coil 202 than in the case where the superconducting coil is directly refrigerated by a refrigerator without a coolant. According to such a cooling method, the object can be rapidly cooled down to a temperature lower than the solidified coolant (for example, 63.1K for solid nitrogen) by the cooling operation of the refrigerator after cooling by the liquid coolant. Superconducting coil 202 rapidly gains a low temperature where a high current density can be achieved.

Figure 26:
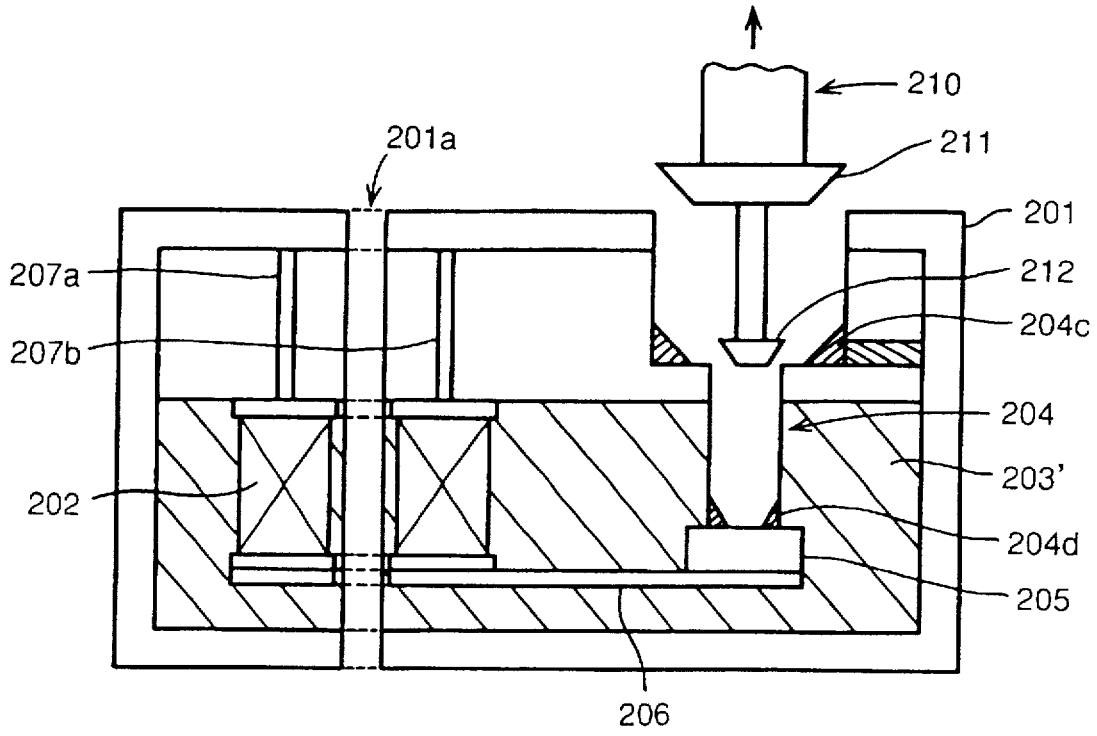
FIG. 26 is a schematic diagram showing a manner of detaching the refrigerator from the apparatus of FIG. 25.
Figure 27:
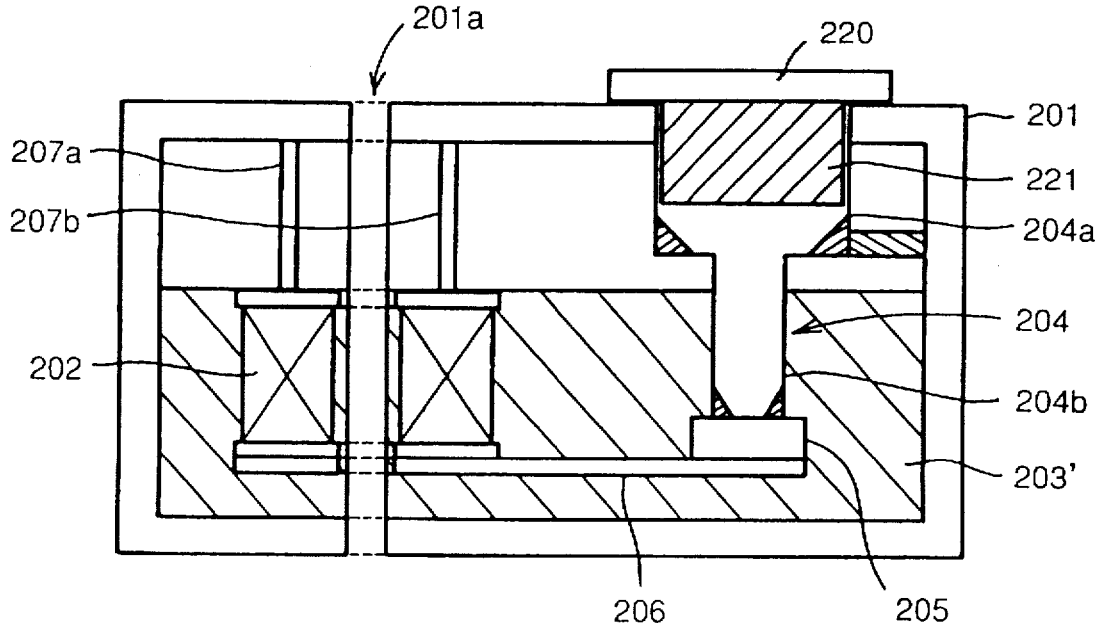
FIG. 27 is a schematic diagram showing a capped apparatus after the refrigerator is detached as shown in FIG. 26.
Figure 28:
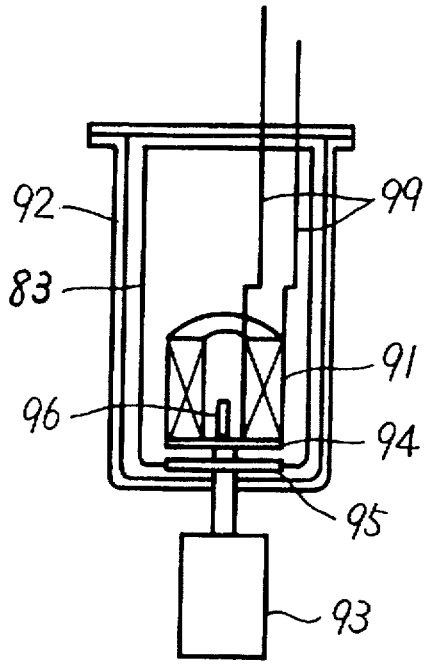
FIG.28 PRIOR ART
FIG. 28 is a schematic diagram showing an example of a conventional cooling apparatus.
Figure 29:
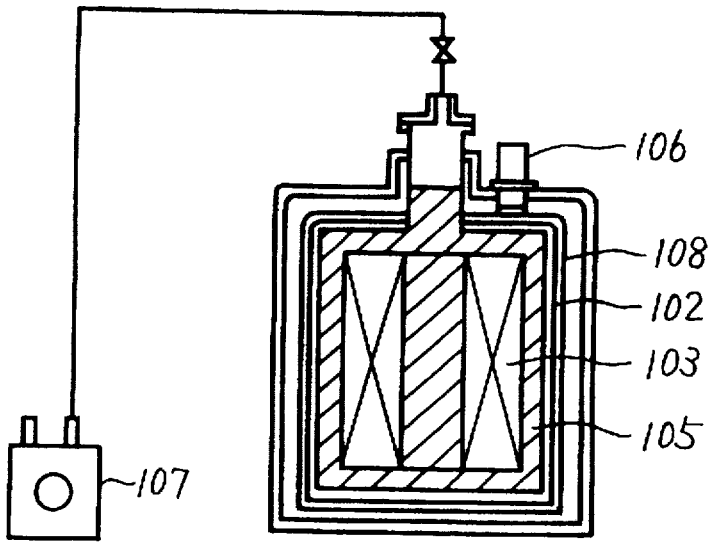
FIG.29 PRIOR ART
FIG. 29 is a schematic sectional view of a conventional superconducting magnet.

Under the state where the coolant is sufficiently solidified, refrigerator 210 is removed as shown in FIG. 26. The tapered configuration of first and second cooling stages 211 and 212 facilitates the detachment by moving refrigerator 210 relatively in the direction of the arrow. The cooling operation by refrigerator 210 is ceased by this manner. However, the cooled state of superconducting coil 2 can be maintained for a long time since coolant 203' does not easily melt or sublime. Referring to FIG. 24, it is preferable to suppress heat invasion by closing the opening of cylinder 204 with a cap 220. Cap 220 can have a heat insulating material 221 such as polyurethane foam blocking the opening of cylinder 240. Also, a vacuum heat insulating layer or another heat insulating material can be provided inside the cap. By effectively suppressing external heat invasion, coolant 203' can be maintained in a solidified manner for a longer time with the refrigerator removed. Superconducting coil 202 can be maintained in a cooled state for long time period at or below the critical temperature. The apparatus with the refrigerator removed is extremely compact in size to facilitate transportation thereof. The apparatus itself can be moved to a predetermined position in a state as shown in FIG. 27. It is also possible to operate superconducting coil 202 during the transportation.

At an elapse of a certain time, cap 220 can be removed from the apparatus of FIG. 27 to carry out a cooling operation again by refrigerator 210 as shown in FIG. 25. By this cooling operation, the melted coolant is solidified again so as to cool superconducting coil 202. When cooling is effected sufficiently, refrigerator 210 can be detached again. Basically, refrigerator 210 can be detached for any number of times.

In the present invention, the time required for cooling is reduced since the object is initially cooled at once by the coolant. By virtue of the cooling effect of the coolant, the heat insulating structure of the vessel for accommodating the object attached to a cooling stage can be made more simple than the heat insulating structure of a conventional refrigerator. A more simple structure of the heat insulating vessel allows a more compact vessel for cooling a superconducting coil, for example. The distance between the superconducting coil and the ambient temperature space can be reduced by the compact vessel. In such a case, a higher magnetic field can be used effectively.

According to the present invention, cooling can be carried out more rapidly using a coolant having a saturated vapor pressure temperature higher than that of liquid helium. Liquid nitrogen is preferred as the coolant. Additionally, hydrogen, neon, argon, natural gas, ammonia, and the like can be employed as the coolant. A preferable coolant has a saturated vapor pressure temperature of 15K–100K under atmospheric pressure. A coolant is preferably solidified under atmospheric pressure or under decompression at a temperature not higher than the critical temperature of the superconductor. When liquid nitrogen is used as the coolant, the cost for cooling can be reduced extremely in comparison to the case where liquid helium is used. The cooling action by both the coolant and the refrigerator in the present invention gains a lower temperature in comparison to the conventional method of carrying out cooling only with liquid nitrogen. The solidified coolant, for example solid nitrogen, has a high specific heat capacity to maintain the temperature of the cooled superconductor more stably. The solidified coolant suppresses generation of quenching in the superconductor more effectively. In general, the temperature achieved by cooling with only liquid nitrogen is the triple point of 63.1K even when decompression is carried out. By further carrying out the refrigerator cooling as in the present invention, a temperature below this triple point can be achieved even without decompression. When the coolant such as liquid nitrogen is to be cooled more rapidly, on the other hand, the interior of the heat insulating vessel which holds the coolant can be decompressed by a vacuum pump.

Furthermore, the apparatus with the superconductor can be made more compact by removing the refrigerator after the coolant is solidified. This provides the advantage that the arrangement, size, usability, and the like of the apparatus are not restricted by the refrigerator. The apparatus from which a refrigerator is removed can be moved more freely to further improve usability thereof.

By the concurrent usage of the coolant and the refrigerator in the present invention, a superconductor can be cooled more rapidly in a simple system. In particular, the heat insulating structure of the vessel in which a superconductor is housed can be made simple. According to the present invention, cooling to a lower temperature can be achieved using a more economic coolant such as liquid nitrogen instead of costly liquid helium. The time required for cooling can be reduced than by a conventional refrigerator, and the cooling performance of the refrigerator can be gained more rapidly. The temperature of the superconductor and the cooling stage can easily be adjusted using a heater while the refrigerator is operated under a predetermined capacity. The present invention provides a method of cooling at a low cost a superconductor having a higher critical temperature such as an oxide superconductor in a more simple system. Furthermore, the present invention provides a superconductor apparatus maintained at a temperature below or equal to the critical temperature in a more compact state with the refrigerator removed with high usability.

According to the present invention, quenching in a superconductor can be suppressed to allow a more stable operation. The effect of suppressing such quenching allows a current higher than the critical current value level for the superconductor in operation of an apparatus, equipment, and a device such as a superconducting magnet.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooling method for generating and maintaining a superconducting state for a superconductor, comprising the steps of:

attaching said superconductor at a cooling stage of a refrigerator, cooling said superconductor by bringing said superconductor on said cooling stage in contact with a liquid coolant, and further cooling said superconductor by said refrigerator with said superconductor in contact with said coolant, wherein said step of further cooling said superconductor by said refrigerator comprises the step of solidifying said liquid coolant, whereby said superconductor is further cooled by said refrigerator in a state covered with said solidified coolant.

2. The cooling method according to claim 1, further comprising the step of adjusting a temperature of said superconductor in contact with said coolant by a heater provided at or in a neighborhood of said cooling stage.

3. The cooling method according to claim 1, wherein said refrigerator is a multi-stage type refrigerator having a plurality of cooling stages, wherein said superconductor is attached to a cooling stage having a lower achievable temperature among said plurality of cooling stages, and wherein said superconductor attached to said cooling stage of a lower achievable temperature is brought into contact with said coolant while a cooling stage having an achievable temperature higher than the achievable temperature of said cooling stage to which said superconductor is attached is not brought into contact with said coolant.

4. The cooling method according to claim 3, wherein said plurality of cooling stages, said superconductor, and said coolant are accommodated in a heat insulating vessel, wherein said cooling stage of a higher achievable temperature not in contact with said coolant is connected to an inner wall of said heat insulating vessel via a heat conducting member having a thermal conductivity higher than the thermal conductivity of a material forming the inner wall of said heat insulating vessel, and wherein the inner wall portion of said heat insulating vessel not in contact with said coolant is cooled by said cooling stage of a higher achievable temperature via said heat conducting member.

5. The cooling method according to claim 4, wherein said heat insulating vessel consists essentially of stainless steel or fiber reinforced plastic, and includes a vacuum heat insulating layer internally.

6. The cooling method according to claim 1, wherein said superconductor is a coil consisting essentially of an oxide superconducting wire.

7. The cooling method according to claim 6, wherein said coil comprises a plurality of pancake coils stacked, and wherein a spacer having a groove formed to guide said coolant inside said coil is inserted between said plurality of stacked pancake coils.

8. The cooling method according to claim 1, wherein said coolant is liquid nitrogen.

9. The cooling method according to claim 1, wherein said superconductor is an oxide superconductor.

10. An energizing method of a superconductor in the cooling method according to claim 1, which comprises, after solidifying said coolant, the step of conducting to said superconductor covered with said solidified coolant a current not less than a critical current value thereof in a range where quenching is not generated in said superconductor and where a generated electric resistance can be maintained stably.

11. The energizing method according to claim 10, wherein said superconductor is a superconducting coil.

12. A method of cooling a superconductor to its critical temperature or below, said cooling method comprising the steps of:

accommodating said superconductor in a heat insulating vessel, filling said heat insulating vessel with a liquid coolant to bring said superconductor in contact with said coolant, bringing into contact with a cooling stage of a refrigerator a heat conducting member in contact with said superconductor and said coolant provided in said heat insulating vessel for cooling said superconductor and said coolant by thermal conduction via said heat conducting member and said cooling stage, cooling by said refrigerator to solidify said coolant, and detaching said cooling stage of said refrigerator from said heat conducting member to cease cooling by said refrigerator, and maintaining a cooled state of said superconductor by said solidified coolant.

13. The cooling method according to claim 12, wherein said heat conducting member comprises a cooling stage contact unit provided at a cylinder in which a cooling stage of said refrigerator can be inserted in a detachable manner, and a connection unit provided between said contact unit and said superconductor.

14. The cooling method according to claim 12, wherein said coolant is liquid nitrogen, and solid nitrogen is generated by cooling of said refrigerator.

15. The cooling method according to claim 12, wherein said superconductor is an oxide superconductor.

* * * * *